US009666113B2

(12) United States Patent
Nakagawa et al.

(10) Patent No.: US 9,666,113 B2
(45) Date of Patent: May 30, 2017

(54) DISPLAY, IMAGE PROCESSING UNIT, AND DISPLAY METHOD FOR IMPROVING IMAGE QUALITY

(71) Applicant: SONY CORPORATION, Tokyo (JP)

(72) Inventors: Makoto Nakagawa, Tokyo (JP); Tomoya Yano, Kanagawa (JP); Mitsuyasu Asano, Tokyo (JP); Yasuo Inoue, Tokyo (JP); Yohei Funatsu, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 480 days.

(21) Appl. No.: 13/909,863

(22) Filed: Jun. 4, 2013

(65) Prior Publication Data

US 2013/0342587 A1 Dec. 26, 2013

(30) Foreign Application Priority Data

Jun. 22, 2012 (JP) ..... 2012-140867

(51) Int. Cl.

*G09G 5/10* (2006.01)
*G09G 3/20* (2006.01)
*G09G 3/3208* (2016.01)

(52) U.S. Cl.

CPC ..... *G09G 3/20* (2013.01); *G09G 3/3208* (2013.01); *G09G 2300/0452* (2013.01); *G09G 2320/066* (2013.01); *G09G 2340/06* (2013.01); *G09G 2360/16* (2013.01)

(58) Field of Classification Search

CPC .. G09G 3/20; G09G 3/3208; G09G 2320/066; G09G 2300/0452; G09G 2360/16; G09G 2340/06

See application file for complete search history.

(56) References Cited

U.S. PATENT DOCUMENTS 6,005,971 A * 12/1999 Bergman ..... G06T 9/005 345/589
9,123,295 B2 * 9/2015 Jeong ..... G09G 3/3233
2006/0187232 A1 * 8/2006 Kempf ..... G09G 5/04 345/591
2007/0291228 A1 * 12/2007 Huang ..... A61B 3/107 351/212
2008/0150970 A1 6/2008 Ozawa et al.
2009/0169128 A1 * 7/2009 Hentschel ..... G06T 3/4084 382/260
2009/0262245 A1 * 10/2009 Aoki ..... G09G 3/20 348/603
2009/0315921 A1 12/2009 Sakaigawa et al.
2010/0026731 A1 * 2/2010 Konuma ..... G09G 5/04 345/690
2012/0139885 A1 * 6/2012 Iwasa ..... G09G 3/3426 345/207
2012/0306947 A1 * 12/2012 Kim ..... G09G 3/3233 345/694

* cited by examiner

*Primary Examiner* — Kwang-Su Yang
(74) *Attorney, Agent, or Firm* — Chip Law Group

(57) ABSTRACT

A display includes: a gain calculation section obtaining, according to an area of a high luminance region in a frame image, a first gain for each pixel in the region; a determination section determining, based on first luminance information for each pixel in the high luminance region and the first gain, second luminance information for each pixel in the high luminance region; and a display section performing display based on the second luminance information.

20 Claims, 23 Drawing Sheets

FIG. 4A
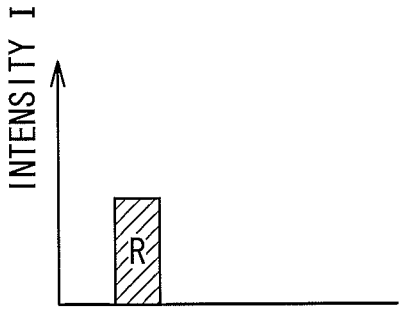
FIG. 4B
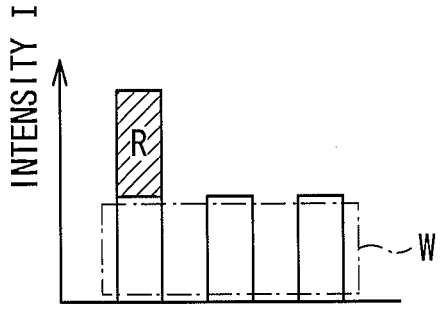
FIG. 4C
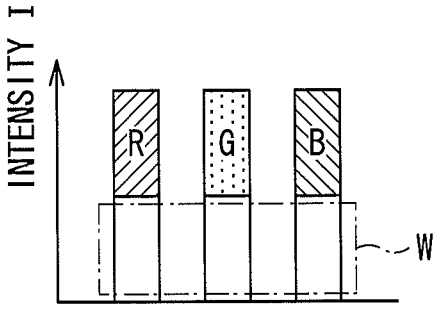
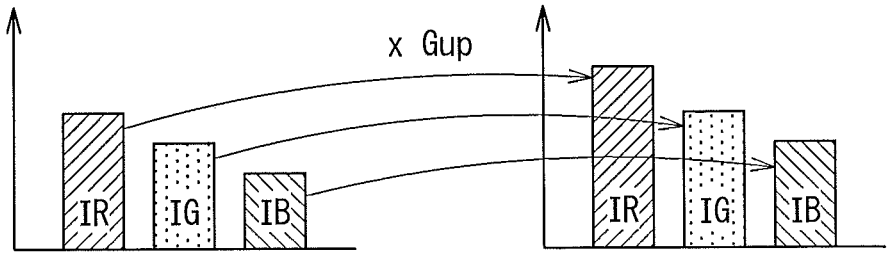
FIG. 5

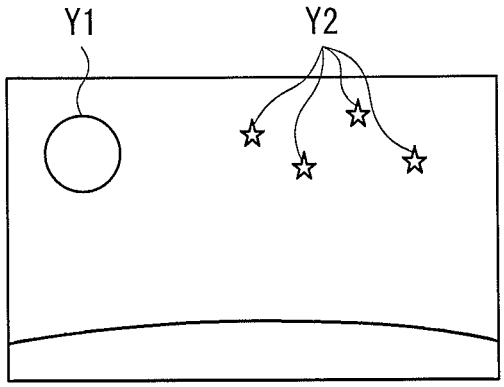
FIG. 15
FIG. 16A
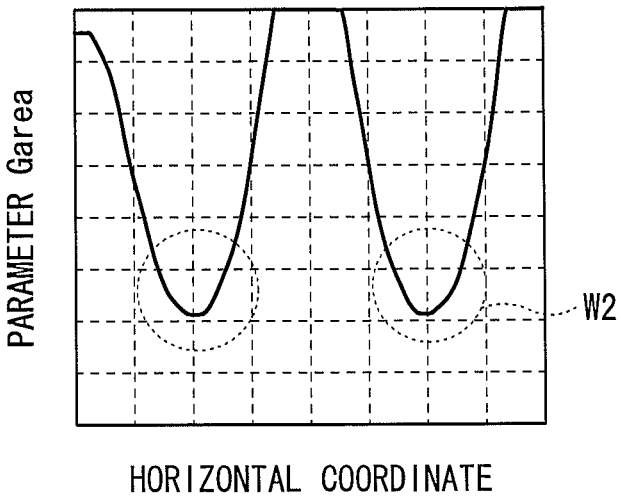
FIG. 16B
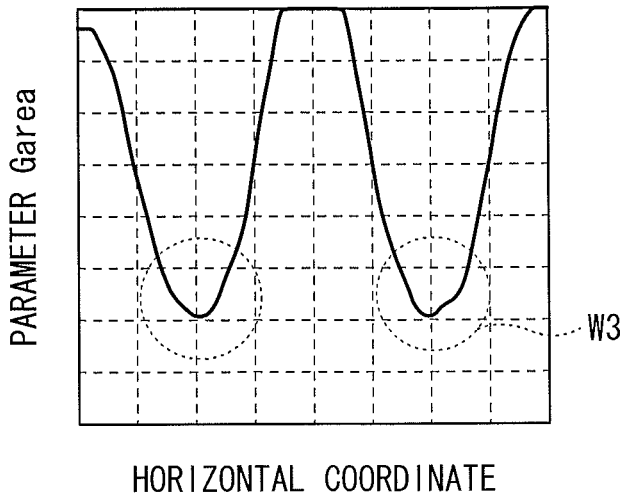

DISPLAY, IMAGE PROCESSING UNIT, AND DISPLAY METHOD FOR IMPROVING IMAGE QUALITY

BACKGROUND

The disclosure relates to a display displaying an image, an image processing unit used for such a display, and a display method.

In recent years, replacement of CRT (Cathode Ray Tube) displays with liquid crystal displays and organic EL (Electro-Luminescence) displays has been proceeding. As compared with the CRT displays, these replacing displays are capable of reducing consumed power and being configured as a thin display, and thus are becoming the mainstream of displays.

In general, displays are expected to have high image quality. There are various factors in determining image quality, and one of these factors is contrast. As one of methods of increasing the contrast, there is a method of increasing peak luminance. Specifically, in this method, a black level is limited by external light reflection and thus is difficult to be reduced, and therefore, an attempt to increase the contrast is made by increasing (extending) the peak luminance. For example, Japanese Unexamined Patent Application Publication No. 2008-158401 discloses a display that attempts to improve image quality and reduce consumed power, by changing an amount (an extension amount) of an increase in peak luminance as well as changing a gamma characteristic, according to an average of image signals.

Meanwhile, there is one type of display in which each pixel is configured using four subpixels. For instance, Japanese Unexamined Patent Application Publication No. 2010-33009 discloses a display capable of, for example, increasing luminance or reducing consumed power, by configuring each pixel with subpixels of red, green, blue, and white.

SUMMARY

As mentioned above, displays are desired to achieve high image quality, and also expected to improve the image quality further.

It is desirable to provide a display, an image processing unit, and a display method, which are capable of improving image quality.

According to an embodiment of the disclosure, there is provided a display including: a gain calculation section obtaining, according to an area of a high luminance region in a frame image, a first gain for each pixel in the region; a determination section determining, based on first luminance information for each pixel in the high luminance region and the first gain, second luminance information for each pixel in the high luminance region; and a display section performing display based on the second luminance information. Here, the "frame image" may include, for example, a field image in performing interlaced display.

According to an embodiment of the disclosure, there is provided an image processing unit including: a gain calculation section obtaining, according to an area of a high luminance region in a frame image, a first gain for each pixel in the region; and a determination section determining, based on first luminance information for each pixel in the high luminance region and the first gain, second luminance information for each pixel in the high luminance region.

According to an embodiment of the disclosure, there is provided a display method including: obtaining, according to an area of a high luminance region in a frame image, a first gain for each pixel in the region; determining, based on first luminance information for each pixel in the high luminance region and the first gain, second luminance information for each pixel in the high luminance region; and performing display based on the second luminance information.

In the display, the image processing unit, and the display method according to the above-described embodiments of the disclosure, the second luminance information for each pixel in the high luminance region is determined based on the first luminance information for each pixel in the high luminance region and the first gain, and display is performed based on the second luminance information. The first gain is a gain obtained according to the area of the high luminance region in the frame image.

According to the display, the image processing unit, and the display method in the above-described embodiments of the disclosure, the first gain obtained according to the area of the high luminance region in the frame image is used. Therefore, image quality is allowed to be improved.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to describe the principles of the technology.

FIGS. 4A to 4C are explanatory diagrams each illustrating an example of luminance information.

FIG. 5 is an explanatory diagram illustrating an operation example of a peak-luminance extension section illustrated in FIG. 1.

FIG. 15 is an explanatory diagram illustrating another operation example of the peak-luminance extension section illustrated in FIG. 1.

FIGS. 16A and 16B are explanatory diagrams each illustrating an operation example of the Garea calculation section illustrated in FIG. 7.

DETAILED DESCRIPTION

Embodiments of the disclosure will be described in detail with reference to the drawings. It is to be noted that the description will be provided in the following order.

1. First Embodiment
2. Second Embodiment
3. Third Embodiment
4. Fourth Embodiment
5. Application Example

1. First Embodiment

Configuration Example

Overall Configuration Example

Figure 1:
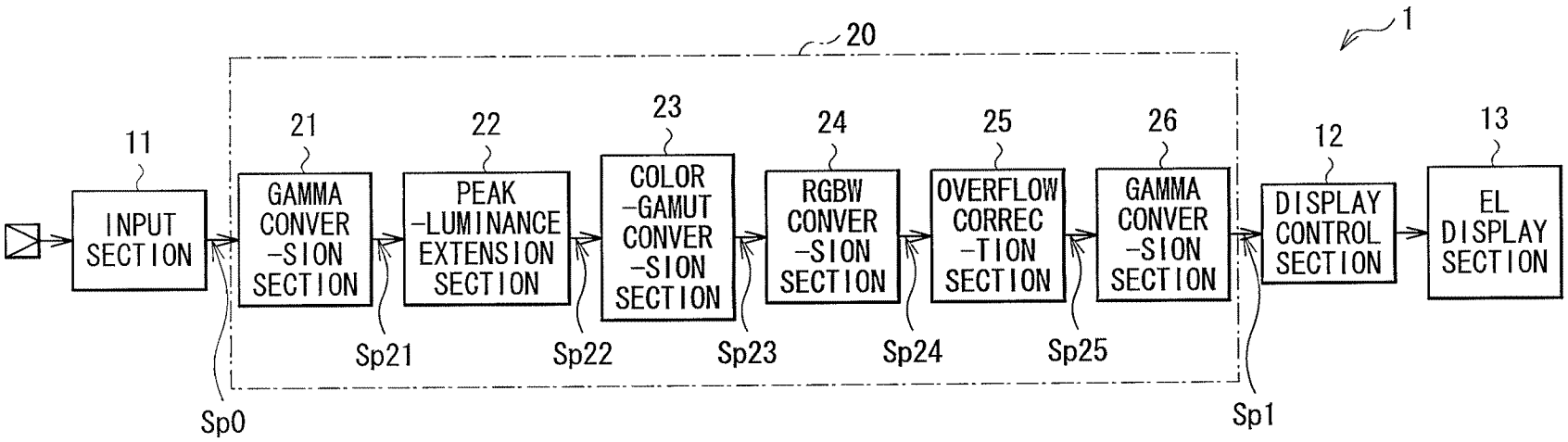
FIG. 1 is a block diagram illustrating a configuration example of a display according to a first embodiment of the disclosure.

FIG. 1 illustrates a configuration example of a display 1 according to a first embodiment. The display 1 is an EL display using an organic EL display device as a display device. It is to be noted that an image processing unit and a display method according to embodiments of the disclosure are embodied by the present embodiment, and thus will be described together with the present embodiment. The display 1 includes an input section 11, an image processing section 20, a display control section 12, and an EL display section 13.

The input section 11 is an input interface that generates an image signal Sp0 based on an image signal supplied from external equipment. In this example, the image signal supplied to the display 1 is a so-called RGB signal including red (R) luminance information IR, green (G) luminance information IG, and blue (B) luminance information IB.

The image processing section 20 generates an image signal Sp1, by performing predetermined image processing such as processing of extending a peak luminance on the image signal Sp0, as will be described later.

The display control section 12 controls display operation in the EL display section 13, based on the image signal Sp1. The EL display section 13 is a display section using the organic EL display device as the display device, and performs the display operation based on the control performed by the display control section 12.

Figure 2:
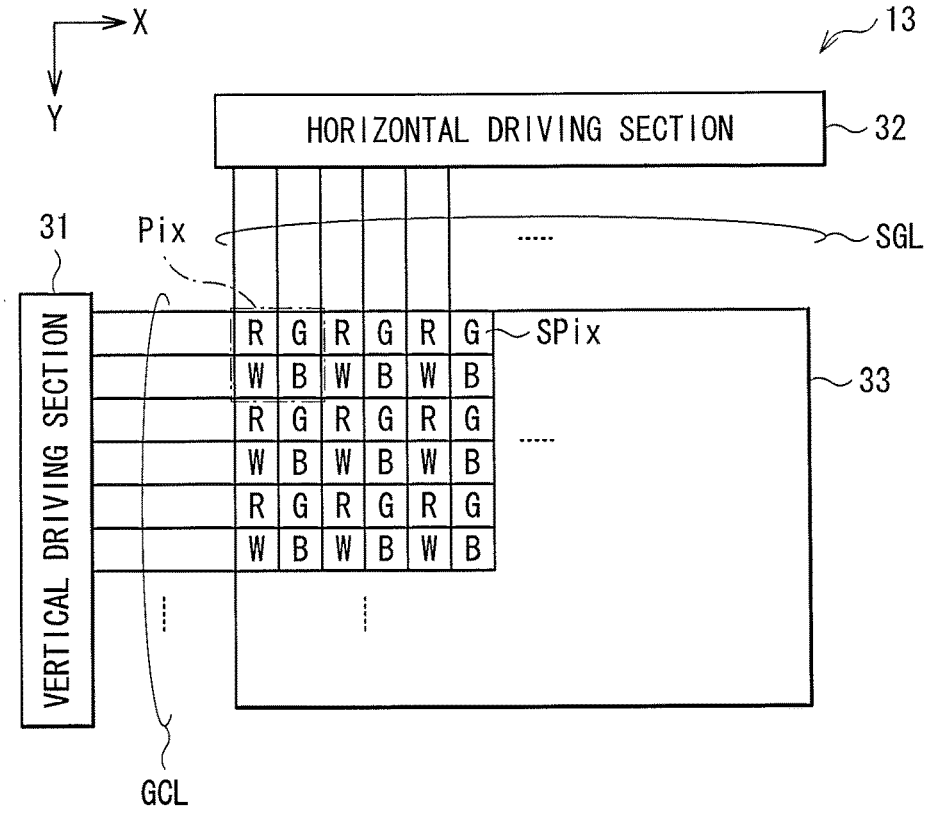
FIG. 2 is a block diagram illustrating a configuration example of an EL display section illustrated in FIG. 1.

FIG. 2 illustrates a configuration example of the EL display section 13. The EL display section 13 includes a pixel array section 33, a vertical driving section 31, and a horizontal driving section 32.

In the pixel array section 33, pixels Pix are arranged in a matrix. In this example, each of the pixels Pix is configured of four subpixels SPix of red (R), green (G), blue (B), and white (W). In this example, these four subpixels SPix are arranged in two rows and two columns in the pixel Pix. Specifically, in the pixel Pix, the red (R) subpixel SPix is arranged to be at upper left, the green (G) subpixel SPix is arranged to be at upper right, the white (W) subpixel SPix is arranged to be at lower left, and the blue (B) subpixel SPix is arranged to be at lower right.

It is to be noted that the colors of the four subpixels SPix are not limited to these colors. For example, a subpixel SPix of other color having high luminosity factor similar to that of white may be used in place of the white subpixel SPix. To be more specific, a subpixel SPix of a color with luminosity factor (e.g. yellow) equal to or higher than that of green that has the highest luminosity factor between red, blue, and green is desirably used.

The horizontal driving section 31 generates a scanning signal based on timing control performed by the display control section 12, supplies the generated scanning signal to the pixel array section 33 through a gate line GCL, and selects the subpixels SPix in the pixel array section 33 line by line, thereby performing line-sequential scanning. The horizontal driving section 32 generates a pixel signal based on the timing control performed by the display control section 12, and supplies the generated pixel signal to the pixel array section 33 through a data line SGL, thereby supplying the pixel signal to each of the subixels SPix in the pixel array section 33.

In this way, the display 1 displays an image by using the four subpixels SPix. This makes it possible to expand a color gamut allowed to be displayed, as will be described below.

Figure 3A:
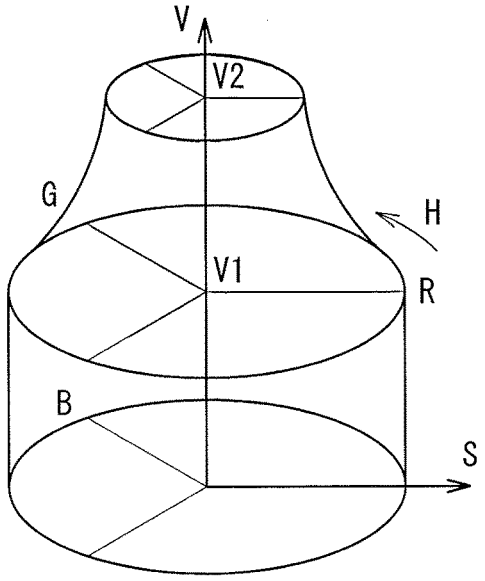
FIGS. 3A and 3B are schematic diagrams illustrating an HSV color space.
Figure 3B:
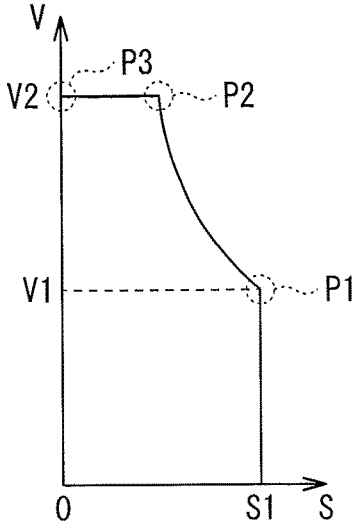

FIGS. 3A and 3B illustrate a color gamut of the display 1, in an HSV color space. FIG. 3A is a perspective diagram, and FIG. 3B is a cross-sectional diagram. In this example, the HSV color space is expressed in a columnar shape. In FIG. 3A, a radial direction indicates "saturation S", an azimuthal direction indicates "hue H", and an axis direction indicates "value V". In this example, FIG. 3B illustrates a cross-sectional diagram in the hue H indicating red. FIGS. 4A to 4C each illustrate an example of light emission operation in the pixel Pix of the display 1.

For example, when only the red subpixel SPix is caused to emit light, a color in a range in which the saturation S is S1 or less and the value V is V1 or less in FIG. 3B may be expressed. As illustrated in FIG. 4A, the color when only the red (R) subpixel SPix is caused to emit light at maximum luminance corresponds to a part P1 (the saturation S="S1" and the value V="V1") in FIG. 3B, in the HSV color space. This also applies to green and blue. In other words, in FIG. 3A, a color range expressible by the three subpixels SPix of red, green, and blue is a lower half of the columnar shape (a range in which the value V is V1 or less).

Meanwhile, as illustrated in FIG. 4B, a color when each of the subpixels SPix of red (R) and white (W) is caused to emit light at maximum luminance corresponds to a part P2 in FIG. 3B, in the HSV color space. Further, as illustrated in FIG. 4C, a color when each of the four subpixels SPix of red (R), green (G), blue (B), and white (W) is caused to emit light at maximum luminance corresponds to a part P3 in FIG. 3B, in the HSV color space. In other words, the value V is allowed to be V2 which is higher than V1, by causing the white subpixel SPix to emit the light.

In this way, it is possible to expand an expressible color gamut by providing the white subpixel SPix in addition to the red, green, and blue subpixels SPix. Specifically, for example, suppose luminance when all the three subpixels SPix of red, green, and blue are each caused to emit the light at the maximum luminance and luminance when the white subpixel SPix is caused to emit the light at the maximum luminance are equal to each other. In this case, it may be possible to realize the luminance twice as high as that in a case in which the three subpixels SPix of red, green, and blue are provided.

(Image Processing Section 20)

The image processing section 20 includes a gamma conversion section 21, a peak-luminance extension section 22, a color-gamut conversion section 23, a RGBW conversion section 24, an overflow correction section 25, and a gamma conversion section 26.

The gamma conversion section 21 converts the inputted image signal Sp0 into an image signal Sp21 having a linear gamma characteristic. In other words, the image signal supplied from outside has a gamma value which may be set to, for example, about 2.2, and has a non-linear gamma characteristic, so as to agree with characteristics of an ordinary display. Therefore, the gamma conversion section 21 converts such a non-linear gamma characteristic into a linear gamma characteristic, so that processing in the image processing section 20 is facilitated. The gamma conversion section 21 has a lookup table (LUT), and performs such gamma conversion by using the lookup table, for example.

The peak-luminance extension section 22 generates an image signal Sp22 by extending peak luminances of luminance information IR, IG, and IB included in the image signal Sp21.

FIG. 5 schematically illustrates an operation example of the peak-luminance extension section 22. The peak-luminance extension section 22 determines a gain Gup based on the three pieces of luminance information IR, IG, and IB (pixel information P) corresponding to each of the pixels Pix, and multiplies each of the three pieces of luminance information IR, IG, and IB by the gain Gup. In this process, as will be described later, the closer to white the colors indicated by the three pieces of luminance information IR, IG, and IB are, the higher the gain Gup is. Thus, the peak-luminance extension section 22 functions to extend the luminance information IR, IG, and IB, so that the closer to white the color is, the further each piece of the luminance information IR, IG, and IB is extended.

Figure 6:
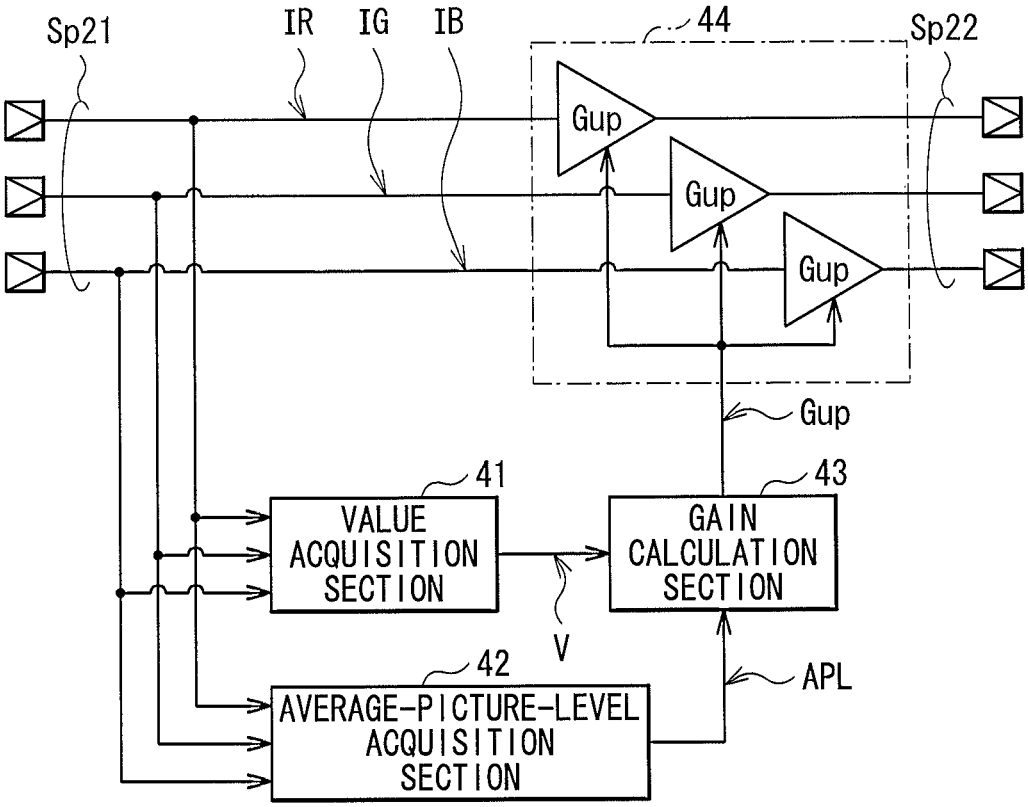
FIG. 6 is a block diagram illustrating a configuration example of the peak-luminance extension section illustrated in FIG. 1.

FIG. 6 illustrates a configuration example of the peak-luminance extension section 22. The peak-luminance extension section 22 includes a value acquisition section 41, an average-picture-level acquisition section 42, a gain calculation section 43, and a multiplication section 44.

The value acquisition section 41 acquires the value V in the HSV color space from the luminance information IR, IG, and IB included in the image signal Sp21. It is to be noted that, in this example, the value V in the HSV color space is acquired, but the technology is not limited thereto. Alternatively, for example, the value acquisition section 41 may be configured to acquire luminance L in the HSL color space, or may be configured to select either of them.

The average-picture-level acquisition section 42 determines and outputs an average (an average picture level APL) of the luminance information in the frame image.

The gain calculation section 43 calculates the gain Gup, based on the value V of each piece of the pixel information P supplied from the value acquisition section 41, and the average picture level APL of each of the frame images supplied from the average-picture-level acquisition section 42.

Figure 7:
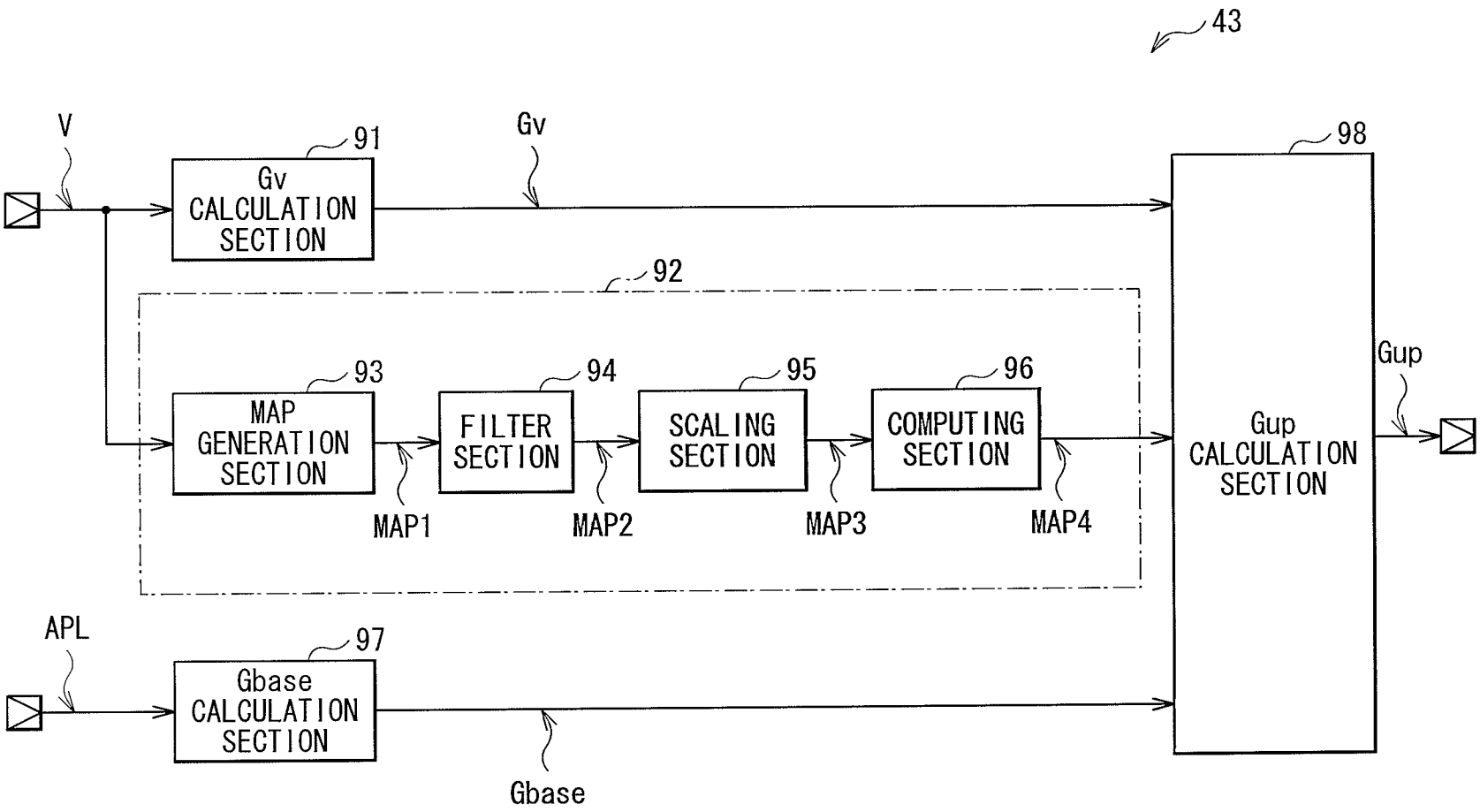
FIG. 7 is a block diagram illustrating a configuration example of a gain calculation section illustrated in FIG. 6.

FIG. 7 illustrates a configuration example of the gain calculation section 43. The gain calculation section 43 includes a Gv calculation section 91, a Garea calculation section 92, a Gbase calculation section 97, and a Gup calculation section 98.

The Gv calculation section 91 calculates a parameter Gv based on the value V as will be described later. The parameter Gv is obtained based on a function using the value V.

The Garea calculation section 92 generates a map for a parameter Garea based on the value V. The Garea calculation section 92 includes a map generation section 93, a filter section 94, a scaling section 95, and a computing section 96.

The map generation section 93 generates a map MAP1, based on the value V acquired from each of the frame images. Specifically, the map generation section 93 divides an image region of the frame image into a plurality of block regions B in a horizontal direction and a vertical direction (e.g. 60×30), and calculates an average (region luminance information IA) of the values V for each of the block regions B, thereby generating the map MAP1. The region luminance information IA represents the average of the values V in the block region B. Therefore, the more the pieces of the pixel information P each having a high value V in the block region B are, in other words, the greater the area of a bright region is, the higher the value of the region luminance information IA is.

It is to be noted that, in this example, the map generation section 93 calculates the average of the values V for each of the block regions B, but is not limited thereto. Alternatively, for example, the number of pieces of the pixel information P having the value V equal to or higher than a predetermined value in each of the block regions B may be calculated.

The filter section 94 generates a map MAP2 by smoothing the region luminance information IA included in the map MAP1, between the block regions B. Specifically, for example, the filter section 94 may be configured using a FIR (Finite Impulse Response) filter of 5 taps, for example.

The scaling section 95 generates a map MAP3 by scaling up the map MAP2 from a map in units of block to a map in units of pixel information P. In other words, the map MAP3 includes information on the values V whose number is equal to the number of the pixels Pix in the EL display section 13. In this process, for example, the scaling section 95 may perform this scaleup by using interpolation processing such as linear interpolation and bicubic interpolation.

The computing section 96 generates a map MAP4 for the parameter Garea, based on the map MAP3. For example, the computing section 96 includes a lookup table, and calculates the parameter Garea for every piece of the pixel information P based on each piece of data of the map MAP3, by using the lookup table.

The Gbase calculation section 97 calculates a parameter Gbase based on the average picture level APL. For example, the Gbase calculation section 97 has a lookup table, and calculates the parameter Gbase based on the average picture level APL by using the lookup table, as will be described later.

The Gup calculation section 98 calculates the gain Gup by performing a predetermined computation based on the parameters Gv, Gbase, and Garea, as will be described later.

In FIG. 6, the multiplication section 44 generates an image signal Sp22, by multiplying the luminance information IR, IG, and IB by the gain Gup calculated by the gain calculation section 43.

In FIG. 1, the color-gamut conversion section 23 generates an image signal Sp23 by converting a color gamut and a color temperature expressed by the image signal Sp22 into a color gamut and a color temperature of the EL display section 13. Specifically, the color-gamut conversion section 23 converts the color gamut and the color temperature by performing, for example, a 3 by 3 matrix conversion. It is to be noted that, in a use in which conversion of a color gamut is not necessary, such as when the color gamut of an input signal and the color gamut of the EL display section 13 agree with each other, only conversion of a color temperature may be performed through processing using a coefficient used to correct the color temperature.

The RGBW conversion section 24 generates a RGBW signal, based on the image signal Sp23 that is a RGB signal. The RGBW conversion section 24 then outputs the generated RGBW signal as an image signal Sp24. Specifically, the RGBW conversion section 24 converts the RGB signal including the luminance information IR, IG, and IB of three colors of red (R), green (G), and blue (B), into the RGBW signal including luminance information IR2, IG2, IB2, and IW2 of four colors of red (R), green (G), blue (B), and white (W).

Figure 8:
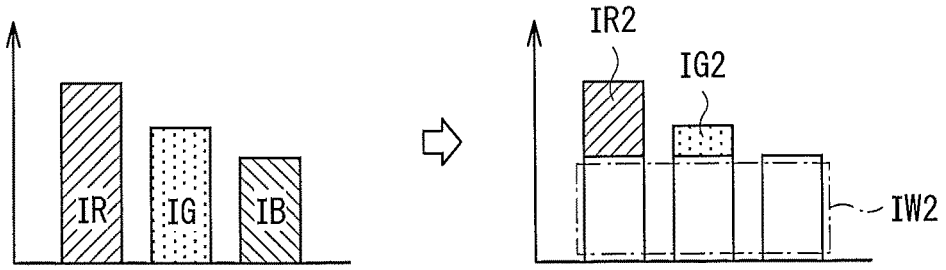
FIG. 8 is an explanatory diagram illustrating an operation example of a RGBW conversion section illustrated in FIG. 1.

FIG. 8 schematically illustrates an operation example of the RGBW conversion section 24. First, the RGBW conversion section 24 assumes a minimum one between the inputted luminance information IR, IG, and IB of three colors (in this example, the luminance information IB is the minimum), to be the luminance information IW2. The RGBW conversion section 24 then obtains the luminance information IR2 by subtracting the luminance information IW2 from the luminance information IR. The RGBW conversion section 24 also obtains the luminance information IG2 by subtracting the luminance information IW2 from the luminance information IG. The RGBW conversion section 24 also obtains the luminance information IB2 by subtracting the luminance information IW2 from the luminance information IB (zero, in this example). The RGBW conversion section 24 outputs the thus obtained luminance information IR2, IG2, IB2, and IW2, as the RGBW signal.

The overflow correction section 25 makes a correction (an overflow correction) so that each piece of the luminance information IR2, IG2, and IB2 included in the image signal Sp24 does not exceed a predetermined luminance level. The overflow correction section 25 then outputs a result of the correction as an image signal Sp25.

Figure 9:
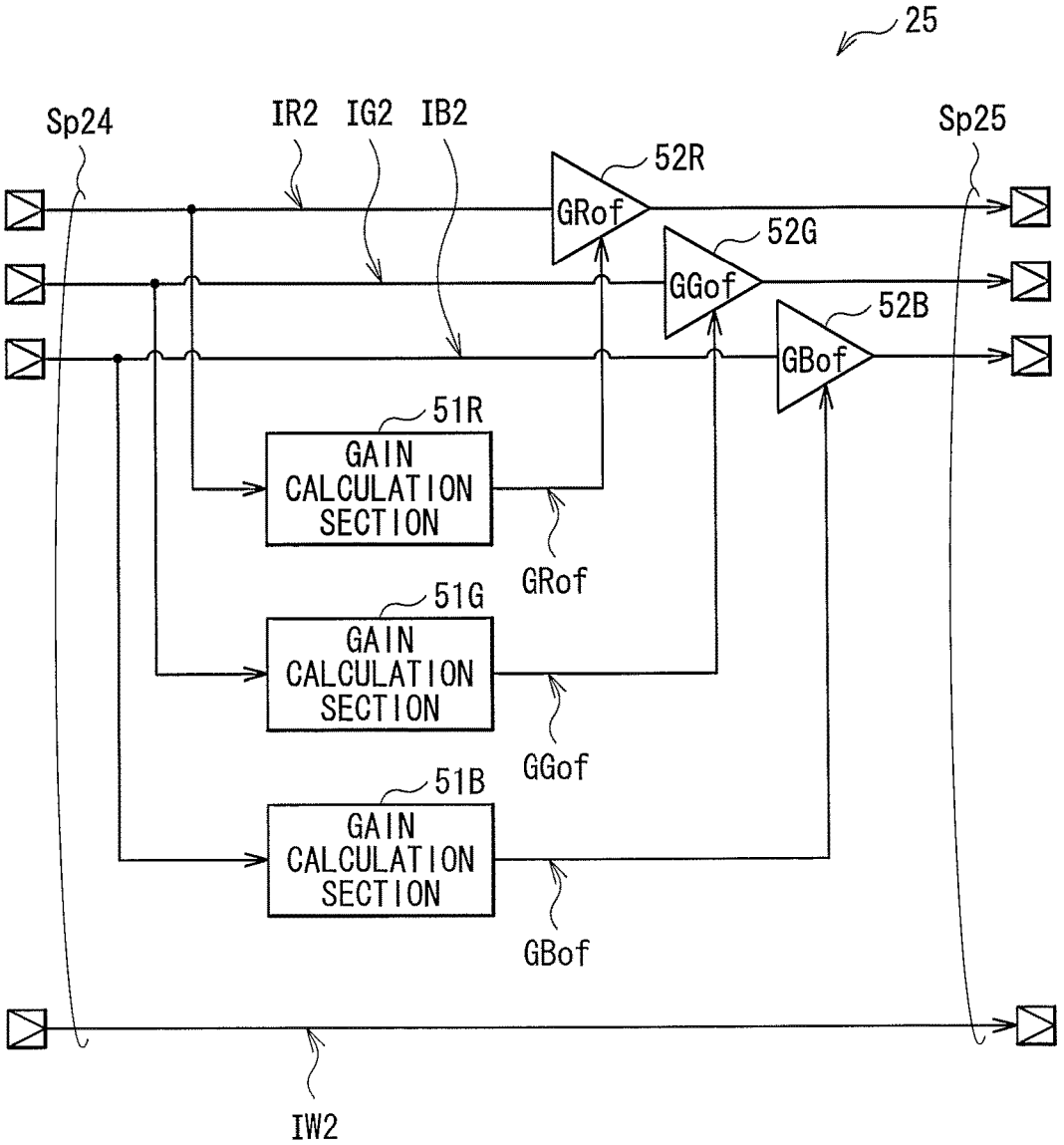
FIG. 9 is a block diagram illustrating a configuration example of an overflow correction section illustrated in FIG. 1.

FIG. 9 illustrates a configuration example of the overflow correction section 25. The overflow correction section 25 includes gain calculation sections 51R, 51G, and 51B, and amplifier sections 52R, 52G, and 52B. The gain calculation section 51R calculates a gain GRof based on the luminance information IR2, and the amplifier section 52R multiplies the luminance information IR2 by the gain GRof. Similarly, the gain calculation section 51G calculates a gain GGof based on the luminance information IG2, and the amplifier section 52G multiplies the luminance information IG2 by the gain GGof. Likewise, the gain calculation section 51B calculates a gain GBof based on the luminance information IB2, and the amplifier section 52B multiplies the luminance information IB2 by the gain GBof. Meanwhile, the overflow correction section 25 performs no processing on the luminance information IW2, and outputs the luminance information IW2 as it is.

The gain calculation sections 51R, 51G, and 51B determine the gains GRof, GGof, GBof, respectively, that are used to prevent the luminance information IR2, IG2, and IB2 from exceeding the predetermined luminance level, as will be described later. The amplifier sections 52R, 52G, and 52B multiply the luminance information IR2, IG2, and IB2 by the gains GRof, GGof, and GBof, respectively.

The gamma conversion section 26 converts the image signal Sp25 having a linear gamma characteristic into the image signal Sp1 having a non-linear gamma characteristic corresponding to the characteristic of the EL display section 13. For instance, as with the gamma conversion section 21, the gamma conversion section 26 includes a lookup table, and performs such gamma conversion by using the lookup table.

Here, the multiplication section 44 corresponds to a specific but not limitative example of "determination section" in the disclosure. The parameter Garea corresponds to a specific but not limitative example of "first gain" in the disclosure, and the parameter Gv corresponds to a specific but not limitative example of "second gain" in the disclosure. The value V corresponds to a specific but not limitative example of "pixel luminance value" in the disclosure. The image signal Sp21 corresponds to a specific but not limitative example of "first luminance information" in the disclosure, and the image signal Sp22 corresponds to a specific but not limitative example of "second luminance information" in the disclosure. The map MAP1 corresponds to a specific but not limitative example of "first map" in the disclosure, and the map MAP3 corresponds to a specific but not limitative example of "second map" in the disclosure.

[Operation and Functions]

Next, operation and functions of the display 1 of the first embodiment will be described.

(Summary of Overall Operation)

First, a summary of overall operation of the display 1 will be described with reference to FIG. 1 and other figures. The input section 11 generates the image signal Sp0 based on the image signal supplied from external equipment. The gamma conversion section 21 converts the inputted image signal Sp0 into the image signal Sp21 having the linear gamma characteristic. The peak-luminance extension section 22 generates the image signal Sp22 by extending the peak luminance of the luminance information IR, IG, and IB included in the image signal Sp21. The color-gamut conversion section 23 generates the image signal Sp23 by converting the color gamut and the color temperature expressed by the image signal Sp22 into the color gamut and the color temperature of the EL display section 13. The RGBW conversion section 24 generates the RGBW signal based on the image signal Sp23 that is the RGB signal, and outputs the generated RGBW signal as the image signal Sp24. The overflow correction section 25 makes the correction so that each piece of the luminance information IR2, IG2, and IB2 included in the image signal Sp24 does not exceed the predetermined luminance level. The overflow correction section 25 then outputs the result of the correction as the image signal Sp25. The gamma conversion section 26 converts the image signal Sp25 having the linear gamma characteristic, into the image signal Sp1 having the non-linear gamma characteristic corresponding to the characteristic of the EL display section 13. The display control section 12 controls the display operation in the EL display section 13, based on the image signal Sp1. The EL display section 13 performs the display operation, based on the control performed by the display control section 12.

(Peak-Luminance Extension Section 22)

Next, detailed operation of the peak-luminance extension section 22 will be described. In the peak-luminance extension section 22, the value acquisition section 41 acquires the value V for every pixel Pix from the luminance information IR, IG, and IB included in the image signal Sp21, and the average-picture-level acquisition section 42 determines the average (the average picture level APL) of the luminance information in the frame image. The gain calculation section 43 then calculates the gain Gup, based on the value V and the average picture level APL.

Figure 10:
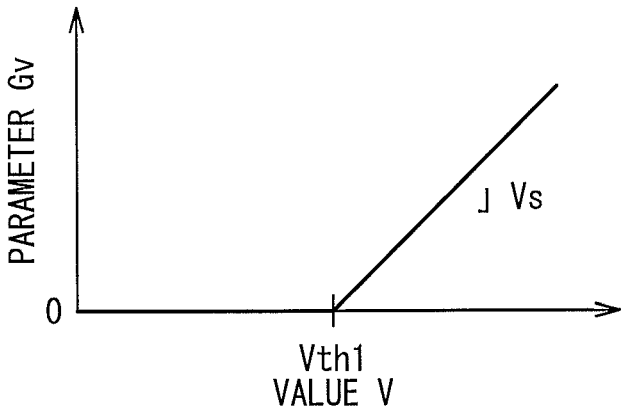
FIG. 10 is an explanatory diagram illustrating a parameter Gv related to a Gv calculation section illustrated in FIG. 7.

FIG. 10 illustrates operation of the Gv calculation section 91 of the gain calculation section 43. The Gv calculation section 91 calculates the parameter Gv based on the value V, as illustrated in FIG. 10. In this example, the parameter Gv is 0 (zero) when the value V is equal to or less than a threshold Vth1, and the parameter Gv increases based on a linear function with a slope Vs when the value V is equal to or larger than the threshold Vth1. In other words, the parameter Gv is identified by two parameters (namely, the threshold Vth1 and the slope Vs).

Further, the Gbase calculation section 97 of the gain calculation section 43 calculates the parameter Gbase based on the average picture level APL. This parameter Gbase is smaller as the average picture level APL of the frame image is higher (brighter), while being greater as the average picture level APL is lower (darker). The Gbase calculation section 97 determines the parameter Gbase, based on the average picture level APL of each of the frame images supplied from the average-picture-level acquisition section 42.

Next, operation of the Garea calculation section 92 will be described.

Figure 11A:
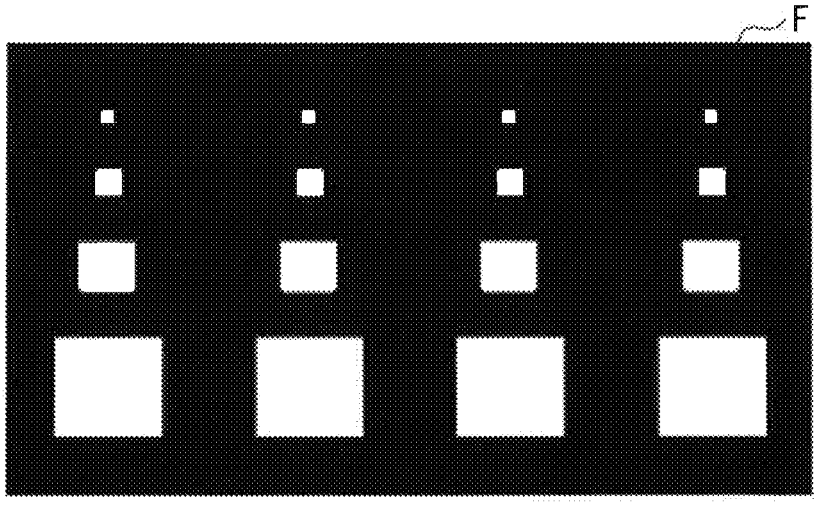
FIGS. 11A to 11C are explanatory diagrams each illustrating an operation example of a Garea calculation section illustrated in FIG. 7.
Figure 11B:
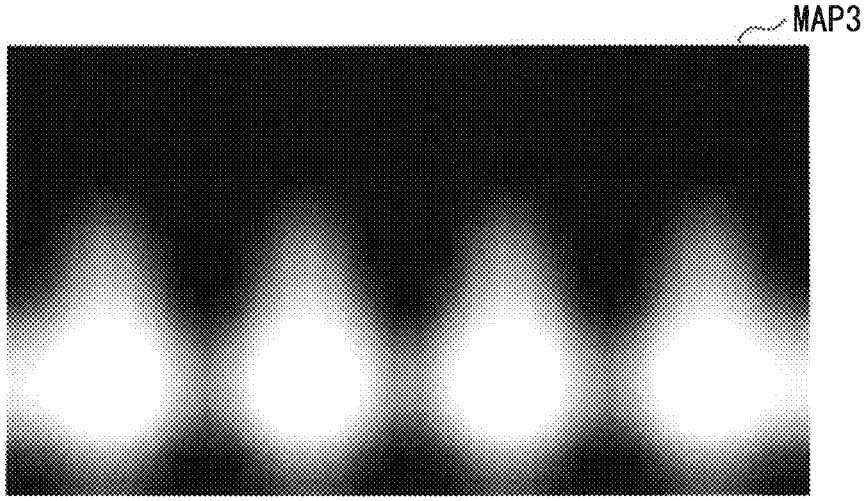
Figure 11C:
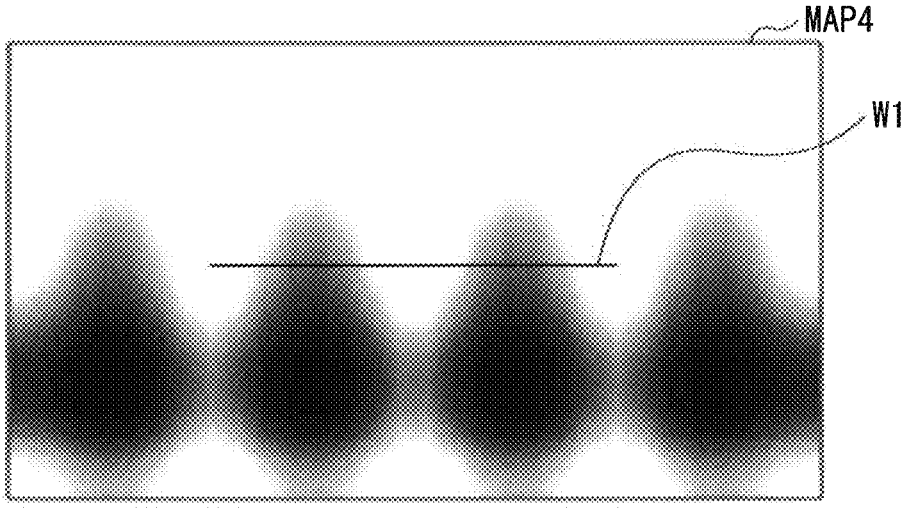

FIGS. 11A to 11C illustrate an operation example of the Garea calculation section 92. FIG. 11A illustrates a frame image F inputted into the display 1, FIG. 11B illustrates the map MAP3, and FIG. 11C illustrates the map MAP4 of the parameter Garea. In FIG. 11C, black indicates that the parameter Garea is small. There is illustrated the greater the parameter Garea is, the more the white results.

In the display 1, at first, the value acquisition section 41 acquires the value V for each piece of the pixel information P based on the frame image F illustrated in FIG. 11A, and supplies the obtained value V to the Garea calculation section 92. In the Garea calculation section 92, at first, the map generation section 93 generates the map MAP1 by calculating the average (the region luminance information IA) of the values V for each of the block regions B. The greater the number of pieces of the pixel information P each having a high value V is, in other words, the greater the area of a bright region is, the higher the value of the region luminance information IA is. Therefore, the map MAP1 is a map indicating the area of a bright region. By the filter section 94, the region luminance information IA included in this map MAP1 is smoothed between the block regions B, and therefore the map MAP2 is generated.

Next, based on the map MAP2, the scaling section 95 scales up the map in units of pixel information P by performing interpolation processing, thereby generating the map MAP3 (FIG. 11B).

Subsequently, based on the map MAP3, the computing section 96 generates the map MAP4 (FIG. 11C) for the parameter Garea.

Figure 12:
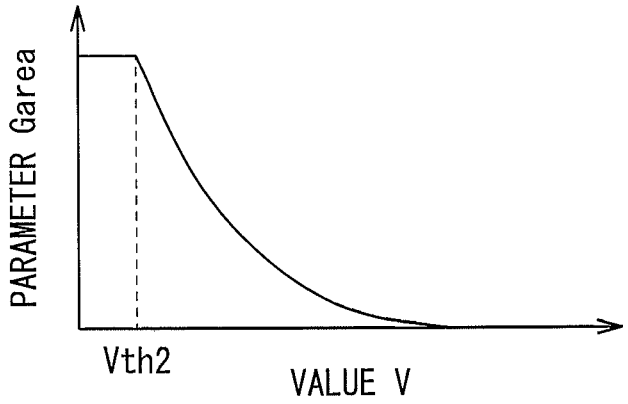
FIG. 12 is an explanatory diagram illustrating a parameter Garea related to the Garea calculation section illustrated in FIG. 7.

FIG. 12 illustrates operation of the computing section 96. The computing section 96 calculates the parameter Garea based on each of the values V included in the map MAP3, as illustrated in FIG. 12. In this example, the parameter Garea is constant when the value V is equal to or less than a threshold Vth2, and the parameter Garea decreases as the value V increases when the value V is equal to or larger than the threshold Vth2.

In this way, the computing section 96 calculates the parameter Garea based on each of the values V included in the map MAP3, thereby generating the map MAP4 (FIG. 11C). In this map MAP4 (FIG. 11C), the parameter Garea is smaller as the area of the bright region is larger (display in black), and the parameter Garea is greater as the area of the bright region is smaller (display in white), in the frame image F (FIG. 11A).

Based on the thus obtained three parameters Gv, Gbase, and Garea, the Gup calculation section 98 calculates the gain Gup for each piece of the pixel information P, by using the following expression (1).

$$Gup=(1+Gv\times Garea)\times Gbase \quad (1)$$

Figure 13:
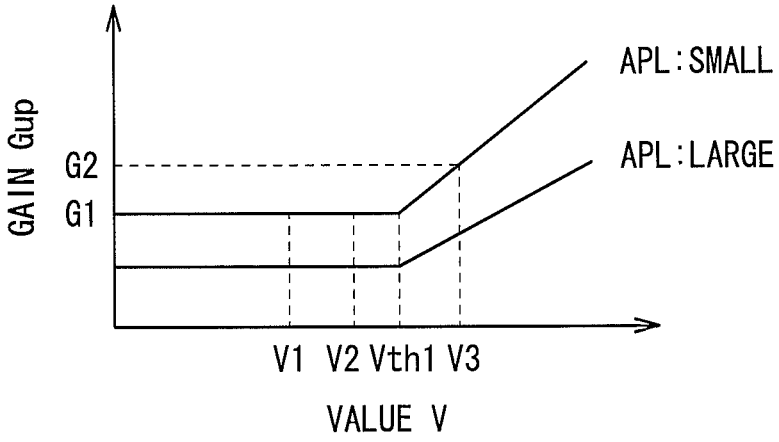
FIG. 13 is an explanatory diagram illustrating a characteristic example of the peak-luminance extension section illustrated in FIG. 1.

FIG. 13 illustrates characteristics of the gain Gup. FIG. 13 illustrates two characteristics in a case in which the average picture level APL is large and a case in which the average picture level APL is small, in a condition where the average picture level APL is constant (the parameter Gbase is constant). In it is to be noted that, in this example, the parameter Garea is constant for convenience of description. As illustrated in FIG. 13, the gain Gup is constant when the value V is equal to or less than the threshold Vth1, and rises with increase in the value V when the value V is equal to or larger than the threshold Vth1. In other words, the closer to white the color indicated by the luminance information IR, IG, and IB is, the higher the gain Gup is. In addition, when the average picture level APL is small, the parameter Gbase is large and thus, the gain Gup is large. In contrast, when the average picture level APL is large, the parameter Gbase is small and thus, the gain Gup is small.

Figure 14A:
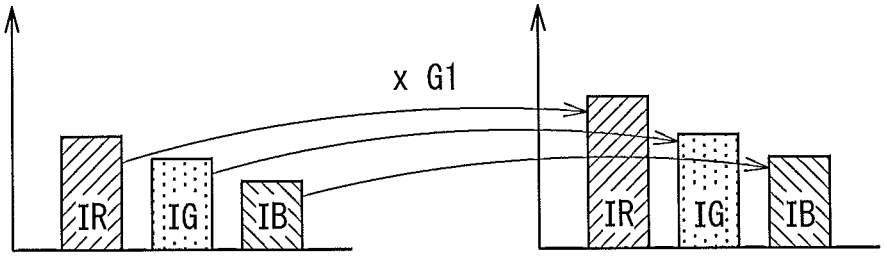
FIGS. 14A to 14C are explanatory diagrams each illustrating an operation example of the peak-luminance extension section illustrated in FIG. 1.
Figure 14B:
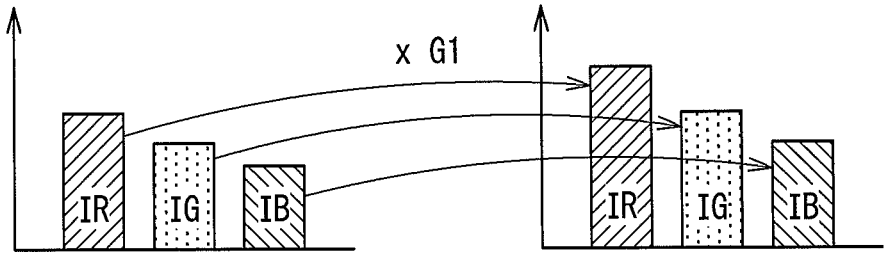
Figure 14C:
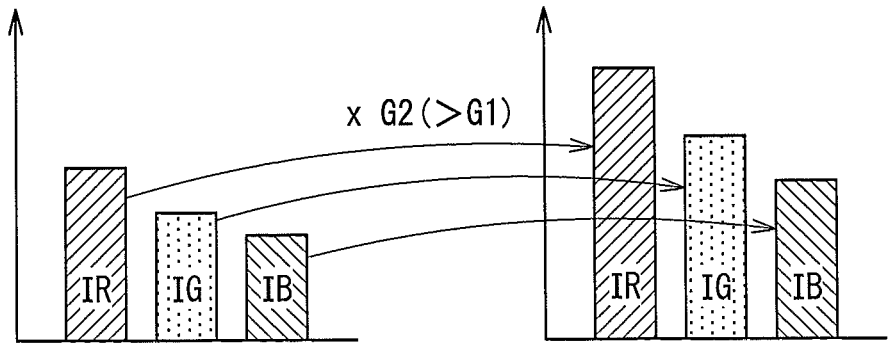

FIGS. 14A to 14C each illustrate an operation example of the peak-luminance extension section 22. FIGS. 14A to 14C illustrate operation at values V1 to V3 when the average picture level APL is small in FIG. 13. FIG. 14A illustrates a case of the value V1, FIG. 14B illustrates a case of the value V2, and FIG. 14C illustrates a case of the value V3. As illustrated in FIG. 13, when the value V is equal to or less than the threshold Vth1, the gain Gup is constant at a gain G1 and thus, the peak-luminance extension section 22 multiplies the luminance information IR, IG, and IB by the same gain G1 as illustrated in FIGS. 14A and 14B. In contrast, as illustrated in FIG. 13, when the value V is equal to or larger than the threshold Vth1, the gain Gup is high and thus, the peak-luminance extension section 22 multiplies the luminance information IR, IG, and IB by a gain G2 that is greater than the gain G1, as illustrated in FIG. 14C.

In this way, the peak-luminance extension section 22 extends the luminance by increasing the gain Gup so that the higher the value V is, the higher the gain Gup is. This makes it possible to increase a dynamic range of an image signal. Therefore, in the display 1, for example, in a case of displaying an image in which stars twinkle in night sky, it may be possible to display the brighter stars. In addition, for example, in a case of displaying metal such as a coin, it may be possible to display an image of high contrast. Specifically, for instance, luster of the metal may be expressed.

In addition, as illustrated in FIG. 13, in the display 1, the gain Gup is constant when the value V is equal to or less than the threshold Vth1, and the gain Gup is higher when the value V is equal to or larger than the threshold Vth1. Therefore, it is possible to reduce the likelihood of a displayed image becoming dark. For instance, in the display disclosed in Japanese Unexamined Patent Application Publication No. 2008-158401, the peak luminance is extended and the gamma characteristic is changed to lower the luminance of low gray-scale. Therefore, in a part except a part related to the extension of the peak luminance in a displayed image, the image is likely to become dark or the image quality is likely to be reduced. In contrast, in the display 1, the gain Gup is constant when the value V is equal to or less than the threshold Vth1. Therefore, an image is unlikely to become dark in a part except a part related to the extension of the peak luminance and thus, a decline in image quality is allowed to be suppressed.

Further, in the display 1, since the gain Gup is changed based on the average picture level APL, an improvement in image quality is achievable. For instance, when a display screen is dark, an adaptation luminance of the eyes of a viewer is low and thus, the viewer is unlikely to perceive a difference in gray-scale of a luminance level in a part where the luminance level is high in the display screen. On the other hand, when the display screen is bright, the adaptation luminance of the eyes of the viewer is high and thus, the viewer is likely to perceive a difference in gray-scale of the luminance level in the part where the luminance level is high in the display screen. In the display 1, the gain Gup is changed based on the average picture level APL. Therefore, for example, when a display screen is dark (i.e. when the average picture level APL is low), the gain Gup is increased so that a viewer is likely to perceive a difference in gray-scale of a luminance level, and when the display screen is bright (i.e. when the average picture level APL is high), the gain Gup is reduced so that the viewer is prevented from perceiving a difference in gray-scale of the luminance level excessively.

Furthermore, in the display 1, since the gain Gup is changed based on the parameter Garea, the image quality is allowed to be enhanced as will be described below.

FIG. 15 illustrates an example of the display screen. In this example, an image with a full moon Y1 and a plurality of stars Y2 in night sky is displayed. When the gain calculation section 43 calculates the gain Gup without using the parameter Garea, the peak-luminance extension section 22 extends the peak luminance for both of the luminance information IR, IG, and IB forming the full moon Y1 and the luminance information IR, IG, and IB forming the stars Y2, in this example. However, a viewer may perceive an increase in brightness of the full moon Y1 whose displayed area is large, but may be unlikely to perceive the similar effect for the stars Y2 because the displayed area of the stars Y2 is small.

Meanwhile, for instance, in the above-mentioned display disclosed in Japanese Unexamined Patent Application Publication No. 2008-158401, when the display is caused to display an image similar to the image illustrated in FIG. 15, the extension of the peak luminance may be likely to be suppressed in the whole screen, by the full moon Y1 whose area of a bright region is large.

In the display 1, in contrast, the gain Gup is changed based on the parameter Garea. Specifically, in the frame image, the larger the area of the bright region is, the smaller the parameter Garea is, and the gain Gup is decreased based on the expression (1). Similarly, the smaller the area of the bright region is, the larger the parameter Garea is, and the gain Gup is increased based on the expression (1). Thus, in the example of FIG. 15, the extension of the peak luminance is suppressed in the full moon Y1 by decreasing the parameter Garea since the area of the bright region is large, and the peak luminance is extended in the stars Y2 since the area of the bright region is small. Therefore, the luminance in the part where the stars Y2 are displayed is relatively high and thus, the image quality is allowed to be enhanced.

Next, a processing order in the image processing section 20 will be described.

In the display 1, the color-gamut conversion section 23 is provided in a stage following the peak-luminance extension section 22, so that the color gamut and the color temperature of the image signal Sp22 for which the peak luminance has been extended is converted into the color gamut and the color temperature of the EL display section 13. Therefore, a decline in the image quality is allowed to be suppressed. In other words, when the peak-luminance extension section 22 is provided in a stage following the color-gamut conversion section 23, the peak-luminance extension section 22 may calculate the gain Gup based on the value V of the luminance information after the color gamut conversion, and therefore, for example, a change in an object (a range of the chromaticity) targeted for extension of the peak luminance may occur, which may be likely to degrade the image quality. In the display 1, however, the color-gamut conversion section 23 is provided in the stage following the peak-luminance extension section 22, and therefore, the above-described change in the object (the range of the chromaticity) targeted for the extension of the peak luminance is unlikely to occur, allowing degradation in image quality to be suppressed.

Further, in the display 1, the RGBW conversion section 24 is provided in a stage following the peak-luminance extension section 22, so that the RGB signal including the luminance information IR, IG, and IB for which the peak luminance has been extended is converted into the RGBW signal. Therefore, a decline in image quality is allowed to be suppressed. Usually, chromaticity of each of the subpixels SPix in the EL display section 13 is likely to change depending on a signal level. Therefore, when the peak-luminance extension section 22 is provided in a stage following the RGBW conversion section 24, chromaticity of a displayed image may shift. In order to avoid this, it is necessary to perform complicated processing in consideration of nonlinearity, when image processing is performed. In the display 1, however, the RGBW conversion section 24 is provided in the stage following the peak-luminance extension section 22, and therefore, the likelihood of occurrence of a shift in the chromaticity of the displayed image is allowed to be reduced.

Furthermore, in the display 1, the scaling section 95 is provided in a stage following the filter section 94 in the Garea calculation section 92 (FIG. 7), so that the map MAP3 is generated by performing the scaleup based on the smoothed map MAP2. Therefore, data in the map MAP3 is allowed to be smoother, and thus, a decline in image quality is allowed to be suppressed.

Moreover, in the display 1, the computing section 96 is provided in a stage following the scaling section 95, so that the computing section 96 determines the parameter Garea based on the map MAP3 after the scaleup. Therefore, a decline in image quality is allowed to be suppressed, as will be described below.

FIGS. 16A and 16B each illustrate the parameter Garea in a line segment W1 in FIG. 11C. FIG. 16A illustrates a case in which the computing section 96 is provided in the stage following the scaling section 95. FIG. 16B illustrates a case in which the computing section 96 is provided in a stage before the scaling section 95, as an example. In the case in which the computing section 96 is provided in the stage following the scaling section 95 (FIG. 16A), as compared with the case in which the computing section 96 is provided in the stage before the scaling section 95 (FIG. 16B), the parameter Garea is allowed to be smoother in a part W2, for example.

A conceivable reason for this is as follows. As illustrated in FIG. 12, when the computing section 96 determines the parameter Garea based on the value V, the parameter Garea after the conversion is likely to become coarse in a part in which an inclination of a characteristic line in FIG. 12 is high. Therefore, in the case in which the computing section 96 is provided in the stage before the scaling section 95, the scaleup is performed based on such a course parameter Garea. Therefore, an error propagates, and, for example, smoothness in a part W3 may be reduced as illustrated in FIG. 16B. In the display 1, however, the computing section 96 is provided in the stage following the scaling section 95. Therefore, it is possible to reduce the likelihood of propagation of an error, which allows the parameter Garea to be smoother as illustrated in FIG. 16A. Thus, in the display 1, a decline in image quality is allowed to be suppressed.

(Overflow Correction Section 25)

Next, the overflow correction in the overflow correction section 25 will be described in detail. In the overflow correction section 25, the gain calculation sections 51R, 51G, and 51B determine the gains GRof, GGof, and GBof, respectively, that prevent the luminance information IR2, IG2, and IB2 from exceeding a predetermined maximum luminance level. The gain calculation sections 51R, 51G, and 51B then multiply the luminance information IR2, IG2, and IB2 by the gains GRof, GGof, and GBof, respectively.

Figure 17A:
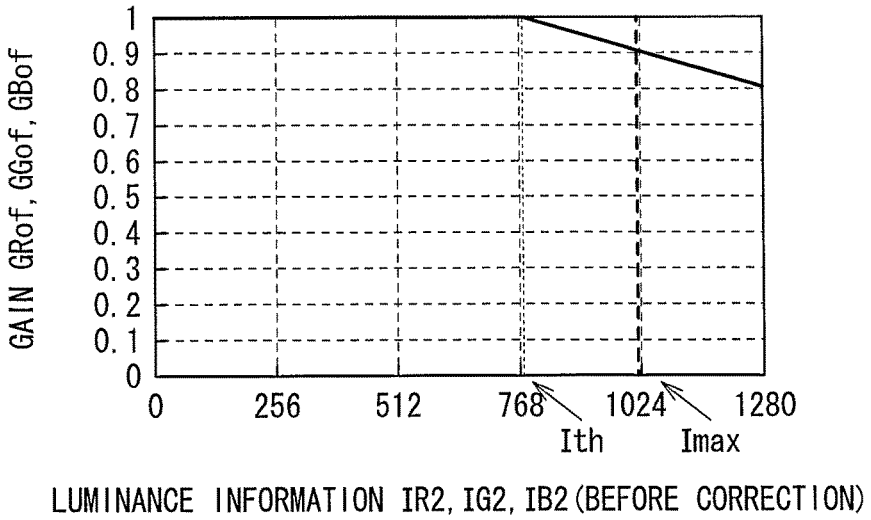
FIGS. 17A and 17B are explanatory diagrams each illustrating a characteristic example of the overflow correction section illustrated in FIG. 1.
Figure 17B:
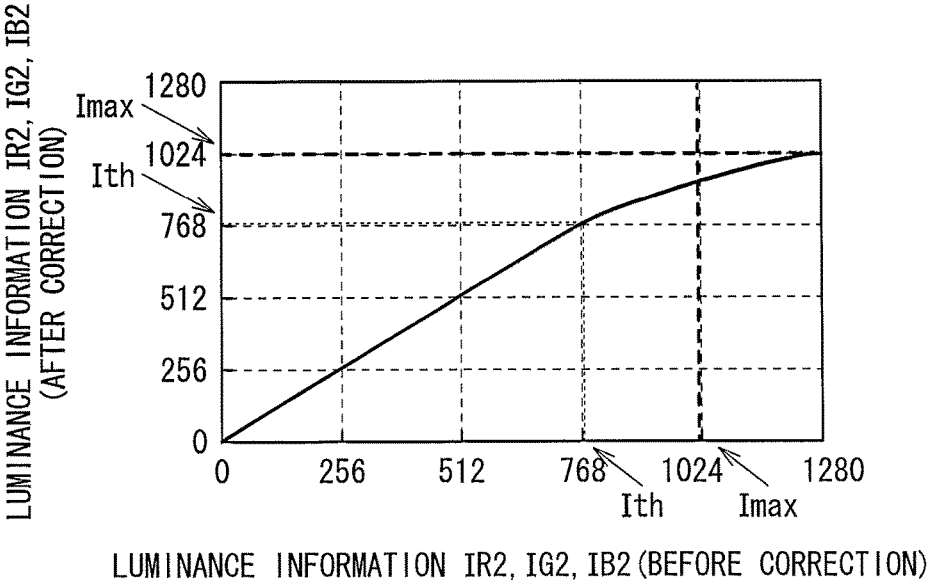

FIGS. 17A and 17B each illustrate an operation example of the overflow correction section 25. FIG. 17A illustrates operation of the gain calculation sections 51R, 51G, and 51B, and FIG. 17B illustrates operation of the amplifier sections 52R, 52G, and 52B. For convenience of description, processing for the luminance information IR2 will be described below as an example. It is to be noted that the following description also applies to processing for the luminance information IG2 and IB2.

The gain calculation section 51R calculates the gain GRof based on the luminance information IR2, as illustrated in FIG. 17A. In this process, the gain calculation section 51R sets the gain GRof at "1", when the luminance information IR2 is equal to or less than a predetermined luminance level Ith. On the other hand, when the luminance information IR2 is equal to or larger than the luminance level Ith, the gain calculation section 51R sets the gain GRof so that the larger the luminance information IR2 is, the lower the gain GRof is.

When the amplifier section 52R multiplies the luminance information IR2 by this gain GRof, the luminance information IR2 (the luminance information IR2 after the correction) outputted from the amplifier section 52R is gradually saturated to reach a predetermined luminance level Imax (1024, in this example) upon exceeding the luminance level Ith, as illustrated in FIG. 17B.

In this way, the overflow correction section 25 makes the correction to prevent the luminance information IR2, IG2, and IB2 from exceeding the predetermined luminance level Imax. This makes it possible to reduce the likelihood of occurrence of a distortion in an image. In other words, in the display 1, the RGBW conversion section 24 performs the RGBW conversion, thereby generating the luminance information IR2, IG2, IB2, and IW2, and the EL display section 13 displays an image based on these pieces of luminance information. In this process, the RGBW conversion section 24 may generate excessive luminance information IR2, IG2, and IB2 that make image display by the EL display section 13 difficult. When the EL display section 13 displays an image based on such excessive luminance information IR2, IG2, and IB2, it is difficult to properly display a part in which the luminance is high and thus, the image may be distorted. In the display 1, however, the overflow correction section 25 is provided to make the correction to prevent the luminance information IR2, IG2, and IB2 from exceeding the luminance level Imax. Therefore, the likelihood of occurrence of a distortion in the image as described above is allowed to be reduced.

Effects

As described above, in the first embodiment, the peak-luminance extension section sets the gain Gup so that the higher the value of the luminance information is, the higher the gain Gup is. Therefore, the contrast is allowed to be increased, which allows an improvement in image quality.

In addition, in the first embodiment, the gain Gup is changed based on the average picture level and thus, the extension of the peak luminance is allowed to be adjusted according to the adaptation luminance of the eyes of a viewer. Therefore, enhancement in image quality is allowed.

Further, in the first embodiment, the gain Gup is changed according to the area of a bright region and therefore, the extension of the peak luminance for a part in which the area of a bright region is large is allowed to be suppressed, and the luminance of a part in which the area of a bright region is small is allowed to be increased relatively. Thus, enhancement in image quality is allowed.

Furthermore, in the first embodiment, the color-gamut conversion section and the RGBW conversion section are provided in the stages following the peak-luminance extension section. Therefore, a decline in image quality is allowed to be suppressed.

Still furthermore, in the first embodiment, the overflow correction section is provided to make the correction to prevent the luminance information from exceeding the predetermined luminance level. Therefore, a decline in image quality is allowed to be suppressed.

In addition, in the first embodiment, the scaling section is provided in the stage following the filter section in the Garea calculation section, so as to perform the scaleup based on the smoothed map MAP2. Thus, a decline in image quality is allowed to be suppressed.

Moreover, in the first embodiment, the computing section is provided in the stage following the scaling section in the Garea calculation section, so as to determine the parameter Garea based on the map MAP3 after the scaleup. Therefore, a decline in image quality is allowed to be suppressed.

[Modification 1-1]

Figure 18:
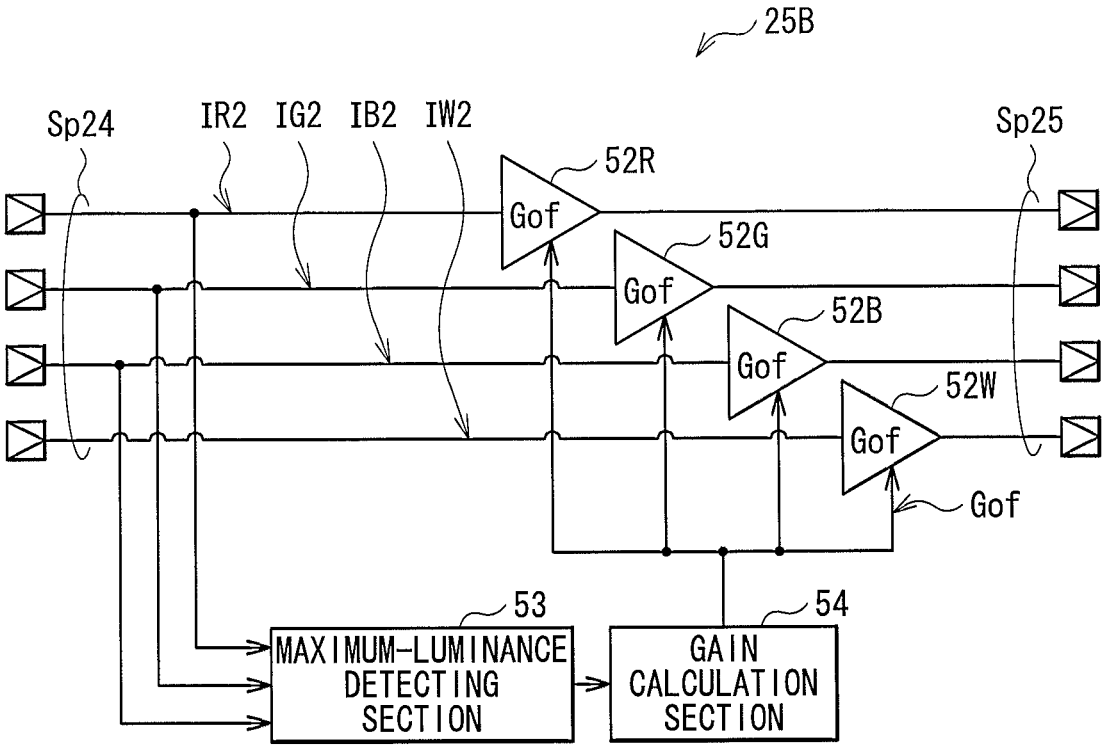
FIG. 18 is a block diagram illustrating a configuration example of an overflow correction section according to a modification of the first embodiment.

In the above-described embodiment, the overflow correction section 25 calculates the gains GRof, GGof, and GBof for each piece of the luminance information IR2, IG2, and IB2, but is not limited thereto. Alternatively, for example, the overflow correction section 25 may calculate a common gain Gof based on the luminance information IR2, IG2, and IB2 as illustrated in FIG. 18. An overflow correction section 25B according to the present modification will be described below in detail.

The overflow correction section 25B includes a maximum-luminance detecting section 53, a gain calculation section 54, and an amplifier section 52W as illustrated in FIG. 18. The maximum-luminance detecting section 53 detects a maximum one between the luminance information IR2, IG2, and IB2. The gain calculation section 54 calculates the gain Gof based on the maximum luminance information detected by the maximum-luminance detecting section 53, in a manner similar to the overflow correction section 25 (FIGS. 17A and 17B). The amplifier sections 52R, 52G, 52B, and 52W multiply the luminance information IR2, IG2, IB2, and IW2 by this gain Gof.

The overflow correction section 25B according to the present modification multiplies the luminance information IR2, IG2, IB2, and IW2 by the common gain Gof. This makes it possible to reduce the likelihood of occurrence of a chromaticity shift. On the other hand, the overflow correction section 25 according to the above-described embodiment calculates the gains GRof, GGof, and GBof for each piece of the luminance information IR2, IG2, and IB2 and thus, a displayed image is allowed to become brighter.

[Modification 1-2]

Figure 19:
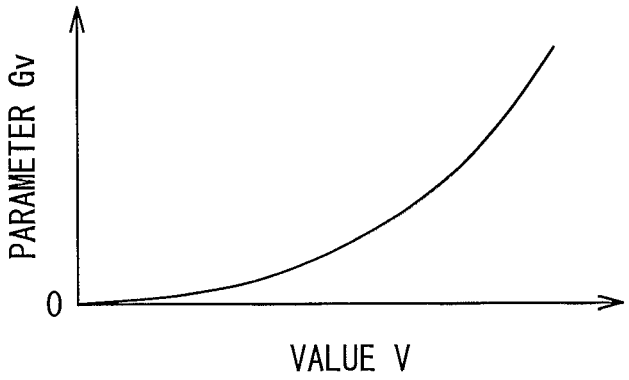
FIG. 19 is an explanatory diagram illustrating a parameter Gv according to another modification of the first embodiment.

In the above-described embodiment, the peak-luminance extension section 22 obtains the parameter Gv based on the function using the value V, but is not limited thereto. Alternatively, for example, the peak-luminance extension section 22 may obtain the parameter Gv based on a lookup table using the value V. In this case, the relationship between the parameter Gv and the value V may be more freely set as illustrated in FIG. 19.

[Modification 1-3]

Figure 20:
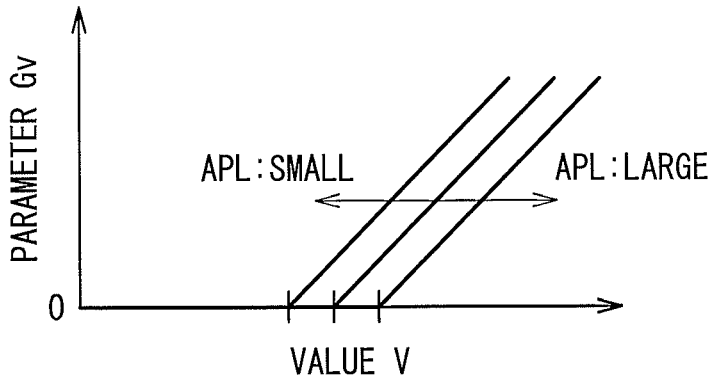
FIG. 20 is an explanatory diagram illustrating a parameter Gv according to still another modification of the first embodiment.
Figure 21:
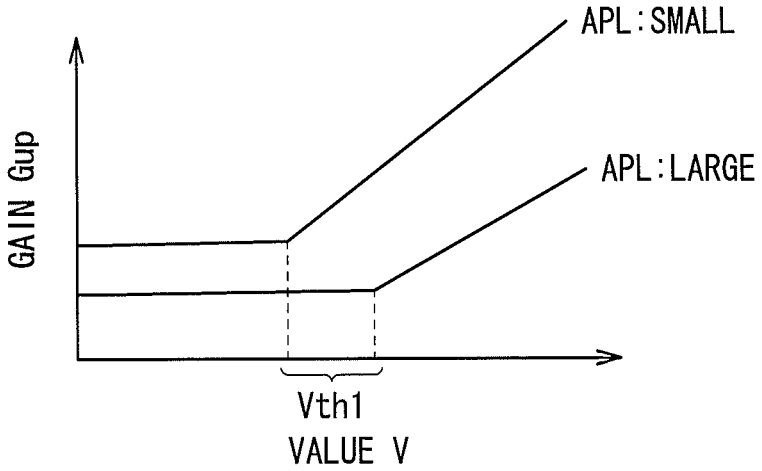
FIG. 21 is an explanatory diagram illustrating a characteristic example of a peak-luminance extension section according to the modification in FIG. 20.

In the above-described embodiment, the peak-luminance extension section 22 assumes the threshold Vth1 in calculating the parameter Gv based on the value V to be the fixed value, but is not limited thereto. Alternatively, for example, the peak-luminance extension section 22 may decrease the threshold Vth1 when the average picture level APL is low, and increase the threshold Vth1 when the average picture level APL is high, as illustrated in FIG. 20. This allows the gain Gup to be increased from a level where the value V is low when the average picture level APL is low, and also allows the gain Gup to be increased from a level where the value V is high when the average picture level APL is high, as illustrated in FIG. 21. Thus, a change in sensitivity resulting from a change in adaptation luminance of the eyes of a viewer is allowed to be compensated for.

2. Second Embodiment

Next, a display 2 according to a second embodiment will be described. In the second embodiment, an overflow correction is made at the time when a peak luminance is extended. It is to be noted that elements that are substantially the same as those of the display 1 according to the first embodiment will be provided with the same reference numerals as those of the first embodiment, and the description thereof will be omitted as appropriate.

Figure 22:
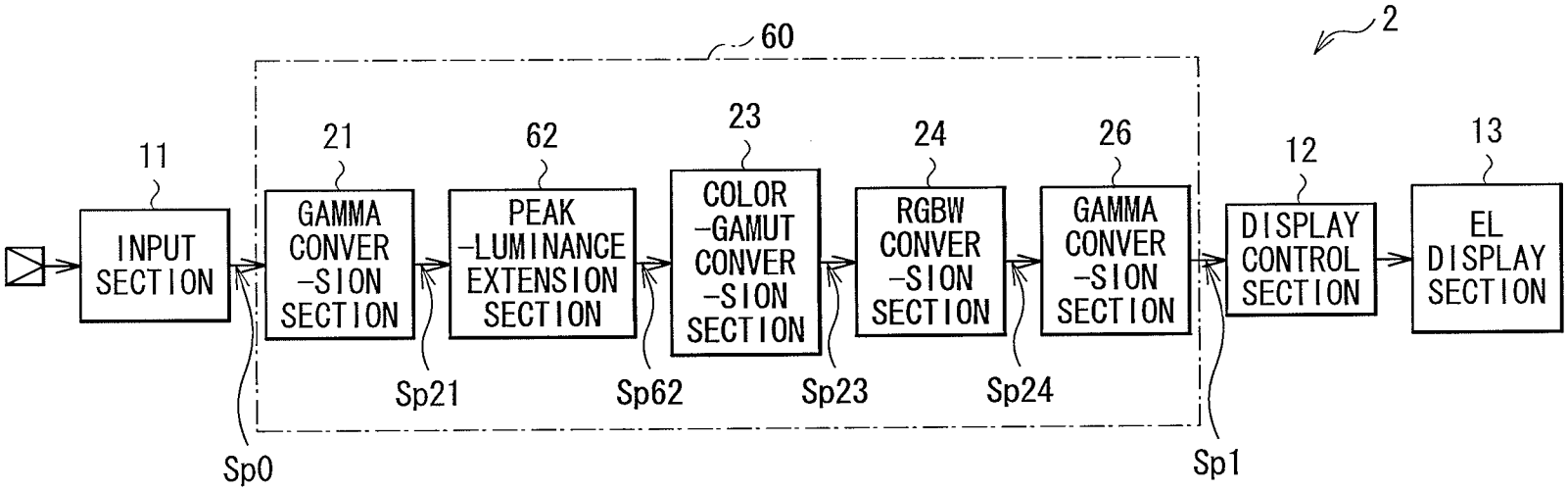
FIG. 22 is a block diagram illustrating a configuration example of a display according to a second embodiment.

FIG. 22 illustrates a configuration example of the display 2 according to the second embodiment. The display 2 includes an image processing section 60 provided with a peak-luminance extension section 62. The peak-luminance extension section 62 performs processing of extending the peak luminance and also performs the overflow correction, thereby generating an image signal Sp62. In other words, the peak-luminance extension section 62 performs the overflow correction before the RGBW conversion. In the display 1 according to the first embodiment, this overflow correction is performed by the overflow correction section 25.

Figure 23:
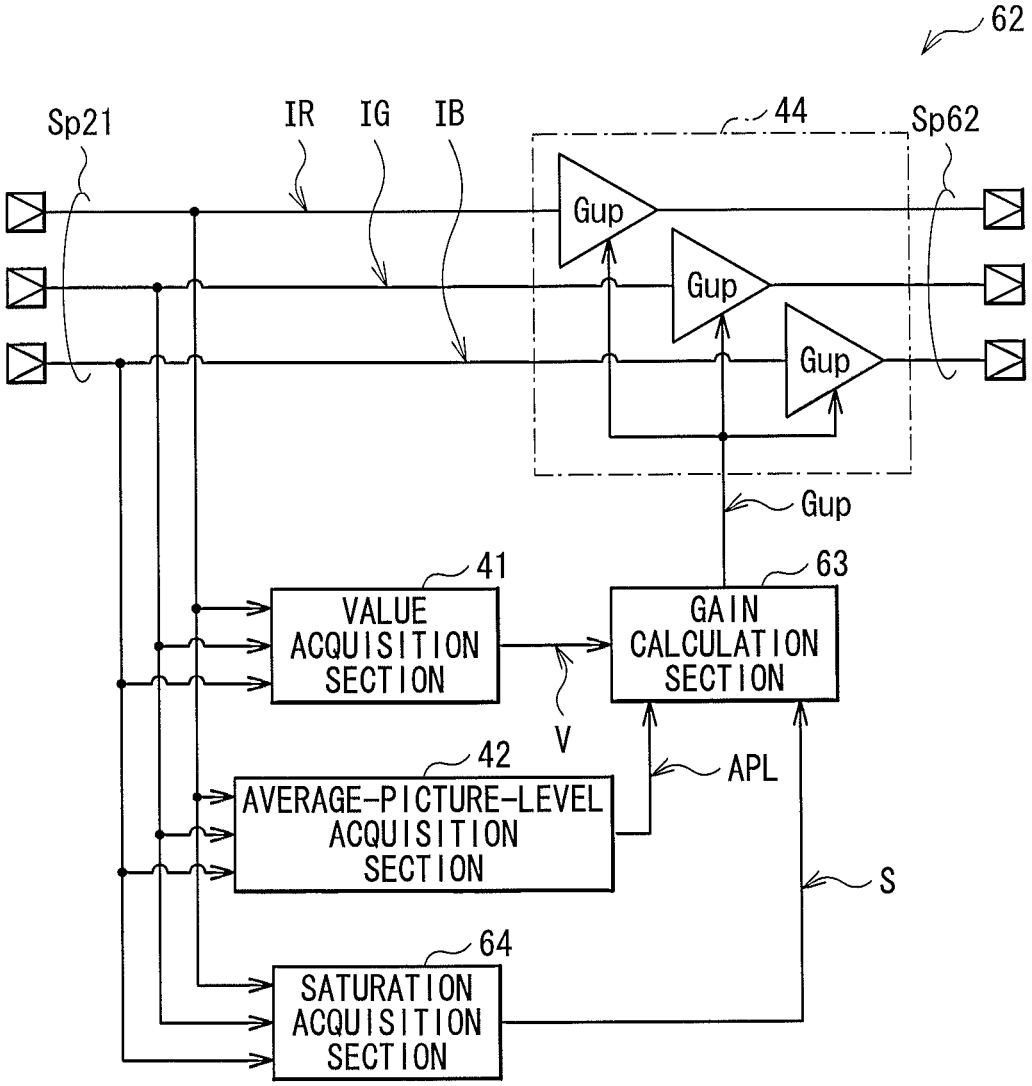
FIG. 23 is an explanatory diagram illustrating an operation example of a peak-luminance extension section illustrated in FIG. 22.

FIG. 23 illustrates a configuration example of the peak-luminance extension section 62. The peak-luminance extension section 62 includes a saturation acquisition section 64 and a gain calculation section 63. The saturation acquisition section 64 acquires a saturation S in an HSV color space for each piece of pixel information P, from luminance information IR, IG, and IB included in an image signal Sp21. The gain calculation section 63 calculates a gain Gup, based on the saturation S acquired by the saturation acquisition section 64, a value V acquired by a value acquisition section 41, and an average picture level APL acquired by an average-picture-level acquisition section 42.

Figure 24:
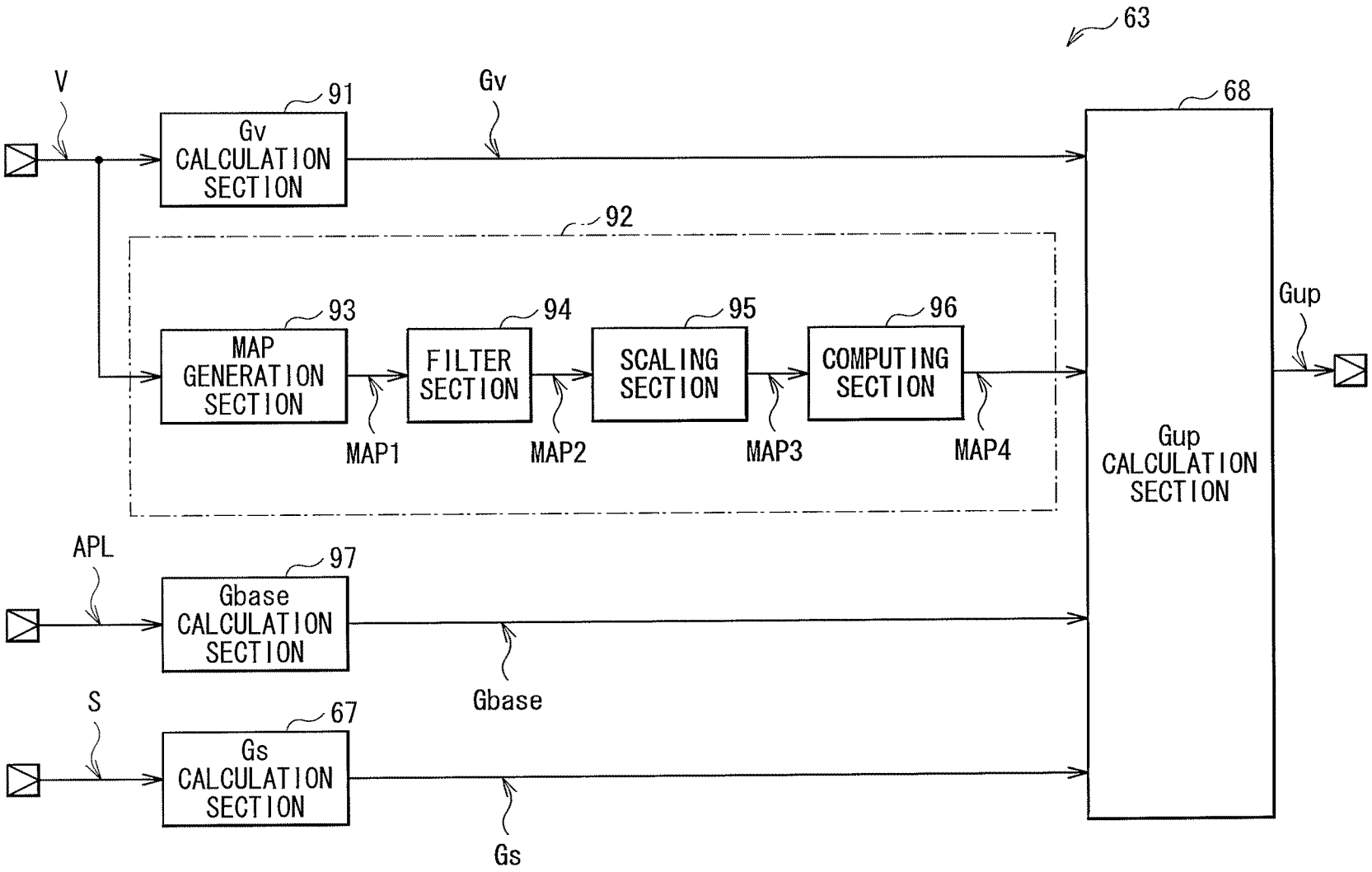
FIG. 24 is a block diagram illustrating a configuration example of a gain calculation section illustrated in FIG. 23.

FIG. 24 illustrates a configuration example of the gain calculation section 63. The gain calculation section 63 includes a Gs calculation section 67 and a Gup calculation section 68.

The Gs calculation section 67 calculates a parameter Gs based on the saturation S. For example, the Gs calculation section 67 includes a lookup table, and calculates the parameter Gs based on the saturation S, by using the lookup table.

Figure 25:
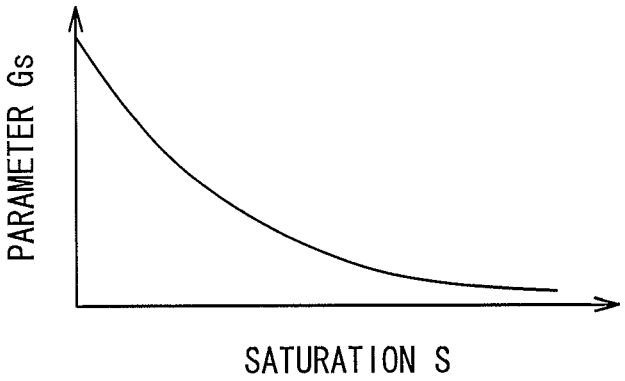
FIG. 25 is an explanatory diagram illustrating a parameter Gs related to a Gs calculation section depicted in FIG. 24.

FIG. 25 illustrates operation of the Gs calculation section 67. The Gs calculation section 67 calculates the parameter Gs based on the saturation S as illustrated in FIG. 25. In this example, the parameter Gs decreases as the saturation S increases.

The Gup calculation section 68 calculates the gain Gup based on the parameters Gv, Gbase, Garea, and Gs, by using the following expression (2).

$$Gup=(1+Gv\times Garea\times Gs)\times Gbase \quad (2)$$

In this way, in the display 2, the parameter Gs becomes smaller as the saturation S becomes greater, and as a result, the gain Gup becomes smaller. Therefore, an effect equivalent to the above-described overflow correction is allowed to be obtained.

As described above, in the second embodiment, the parameter Gs is provided so that the gain Gup is changed by the saturation. Therefore, the peak-luminance extension section is allowed to perform the extension of the peak luminance as well as the overflow correction. Other effects are similar to those of the above-described first embodiment.

[Modification 2-1]

Any of the above-described modifications 1-1 to 1-3 of the first embodiment may be applied to the display 2 according to the second embodiment.

3. Third Embodiment

Next, a display 3 according to a third embodiment will be described. In the third embodiment, a liquid crystal display is configured by using a liquid crystal display device as a display device. It is to be noted that elements that are substantially the same as those of the display 1 according to the first embodiment and the like will be provided with the same reference numerals as those of the first embodiment and the like, and the description thereof will be omitted as appropriate.

Figure 26:
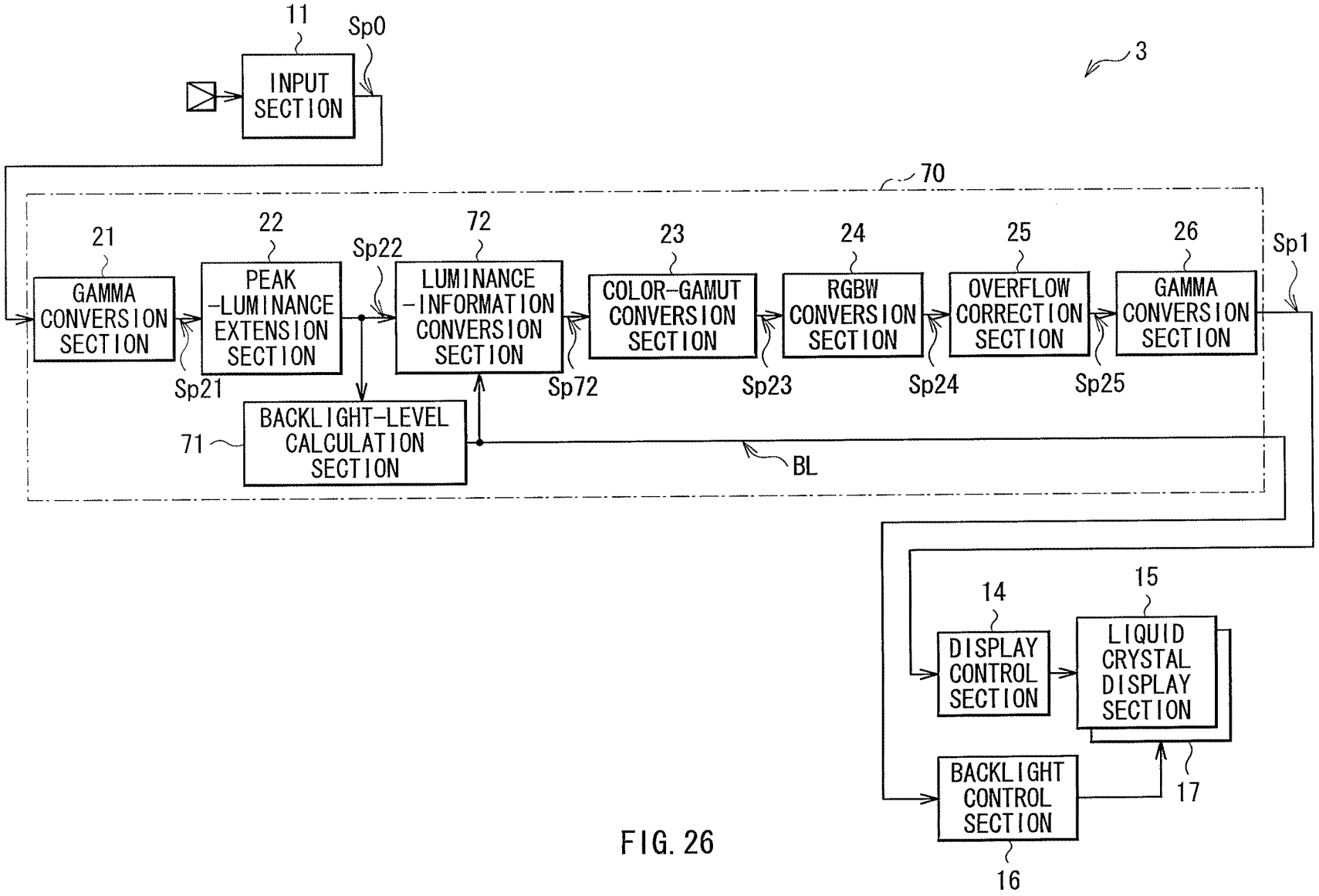
FIG. 26 is a block diagram illustrating a configuration example of a display according to a third embodiment.

FIG. 26 illustrates a configuration example of the display 3. The display 3 includes an image processing section 70, a display control section 14, a liquid crystal display section 15, a backlight control section 16, and a backlight 17.

The image processing section 70 includes a backlight-level calculation section 71 and a luminance-information conversion section 72. The backlight-level calculation section 71 and the luminance-information conversion section 72 are provided to realize a so-called dimming function that allows consumed power of the display 3 to be reduced, as will be described below. The dimming function is described in, for example, Japanese Unexamined Patent Application Publication No. 2012-27405.

Based on an image signal Sp22, the backlight-level calculation section 71 calculates a backlight level BL indicating light emission intensity of the backlight 17. Specifically, for example, the backlight-level calculation section 71 determines a peak value of each piece of luminance information IR, IG, and IB in each of frame images, and calculates the backlight level BL so that the greater the peak value is, the higher the light emission intensity of the backlight 17 is.

The luminance-information conversion section 72 converts the luminance information IR, IG, and IB included in the image signal Sp22 by dividing these pieces of information by the backlight level BL, thereby generating an image signal Sp72.

The display control section 14 controls display operation in the liquid crystal display section 15, based on an image signal Sp1. The liquid crystal display section 15 is a display section using the liquid crystal display device as the display device, and performs the display operation based on the control performed by the display control section 14.

The backlight control section 16 controls emission of light in the backlight 17, based on the backlight level BL. The backlight 17 emits the light based on the control performed by the backlight control section 16, and outputs the light to the liquid crystal display section 15. For example, the backlight 17 may be configured using LED (Light Emitting Diode).

In this configuration of the display 3, the backlight-level calculation section 71 and the luminance-information conversion section 72 adjust the light emission intensity of the backlight 17 according to the luminance information IR, IG, and IB. This allows the display 3 to reduce consumed power.

Further, in the display 3, the backlight-level calculation section 71 and the luminance-information conversion section 72 are provided in stages following a peak-luminance extension section 22, so as to calculate the backlight level BL and convert the luminance information IR, IG, and IB, based on the image signal Sp22 resulting from the extension of the peak luminance. This allows only the peak luminance to be extended, without darkening the full screen.

As described above, effects similar to those of the first embodiment and the like are achievable, by applying the technology to the liquid crystal display.

[Modification 3-1]

Any of the modifications 1-1 to 1-3 of the first embodiment, the second embodiment, and the modification 2-1 thereof may be applied to the display 3 according to the third embodiment.

4. Fourth Embodiment

Next, a display 4 according to a fourth embodiment will be described. In the fourth embodiment, an EL display section is configured using pixels Pix each formed using subpixels SPix of three colors of red, green, and blue. It is to be noted that elements that are substantially the same as those of the display 1 according to the first embodiment and the like will be provided with the same reference numerals as those of the first embodiment and the like, and the description thereof will be omitted as appropriate.

Figure 27:
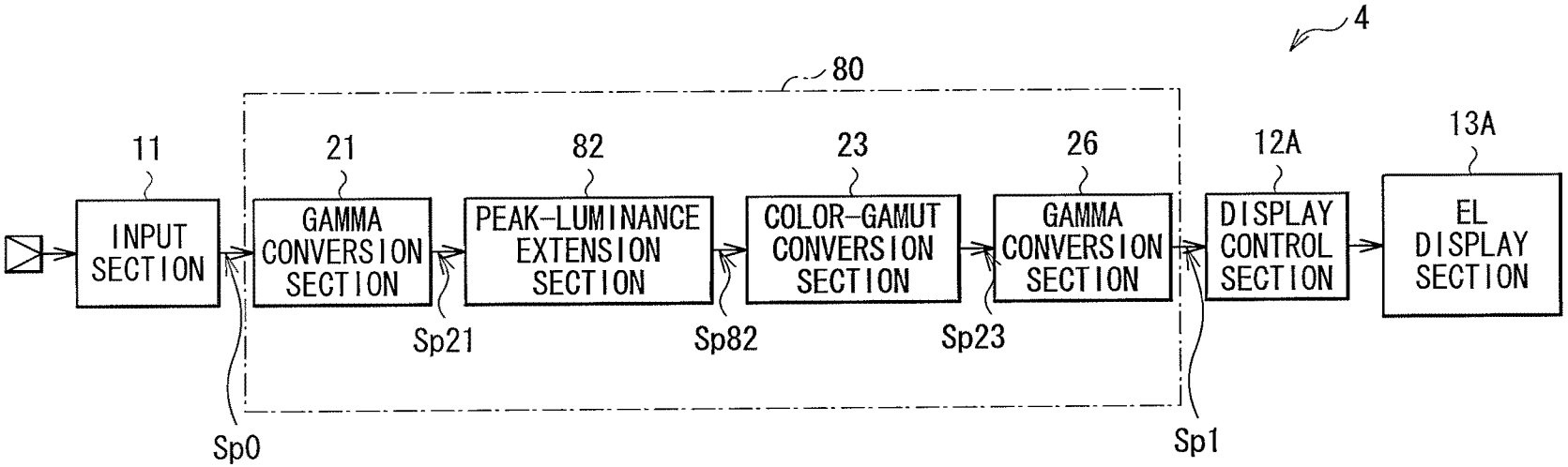
FIG. 27 is a block diagram illustrating a configuration example of a display according to a fourth embodiment.

FIG. 27 illustrates a configuration example of the display 4. The display 4 includes an EL display section 13A, a display control section 12A, and an image processing section 80.

Figure 28:
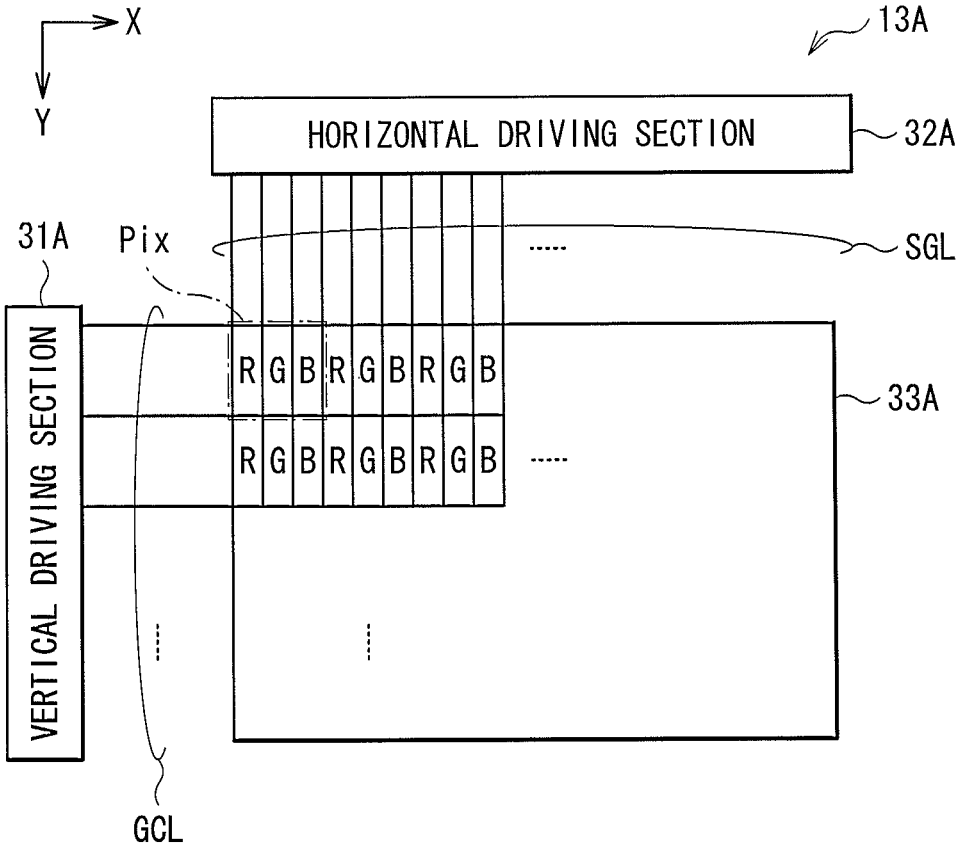
FIG. 28 is a block diagram illustrating a configuration example of an EL display section illustrated in FIG. 27.

FIG. 28 illustrates a configuration example of the EL display section 13A. The EL display section 13A includes a pixel array section 33A, a vertical driving section 31A, and a horizontal driving section 32A. In the pixel array section 33A, the pixels Pix are arranged in a matrix. In this example, each of the pixels is configured using the three subpixels SPix of red (R), green (G), and blue (B) extending in a vertical direction Y. In this example, the subpixels SPix of red (R), green (G), and blue (B) are arranged in this order from left in the pixel Pix. The vertical driving section 31A and the horizontal driving section 32A drive the pixel array section 33A, based on timing control performed by the display control section 12A.

The display control section 12A controls display operation in the EL display section 13A described above.

The image processing section 80 includes a gamma conversion section 21, a peak-luminance extension section 82, a color-gamut conversion section 23, and a gamma conversion section 26, as illustrated in FIG. 27. In other words, the image processing section 80 is equivalent to the image processing section 20 (FIG. 1) according to the first embodiment in which the peak-luminance extension section 22 is replaced with the peak-luminance extension section 82 and from which the RGBW conversion 24 and the overflow correction section 25 are removed.

Figure 29:
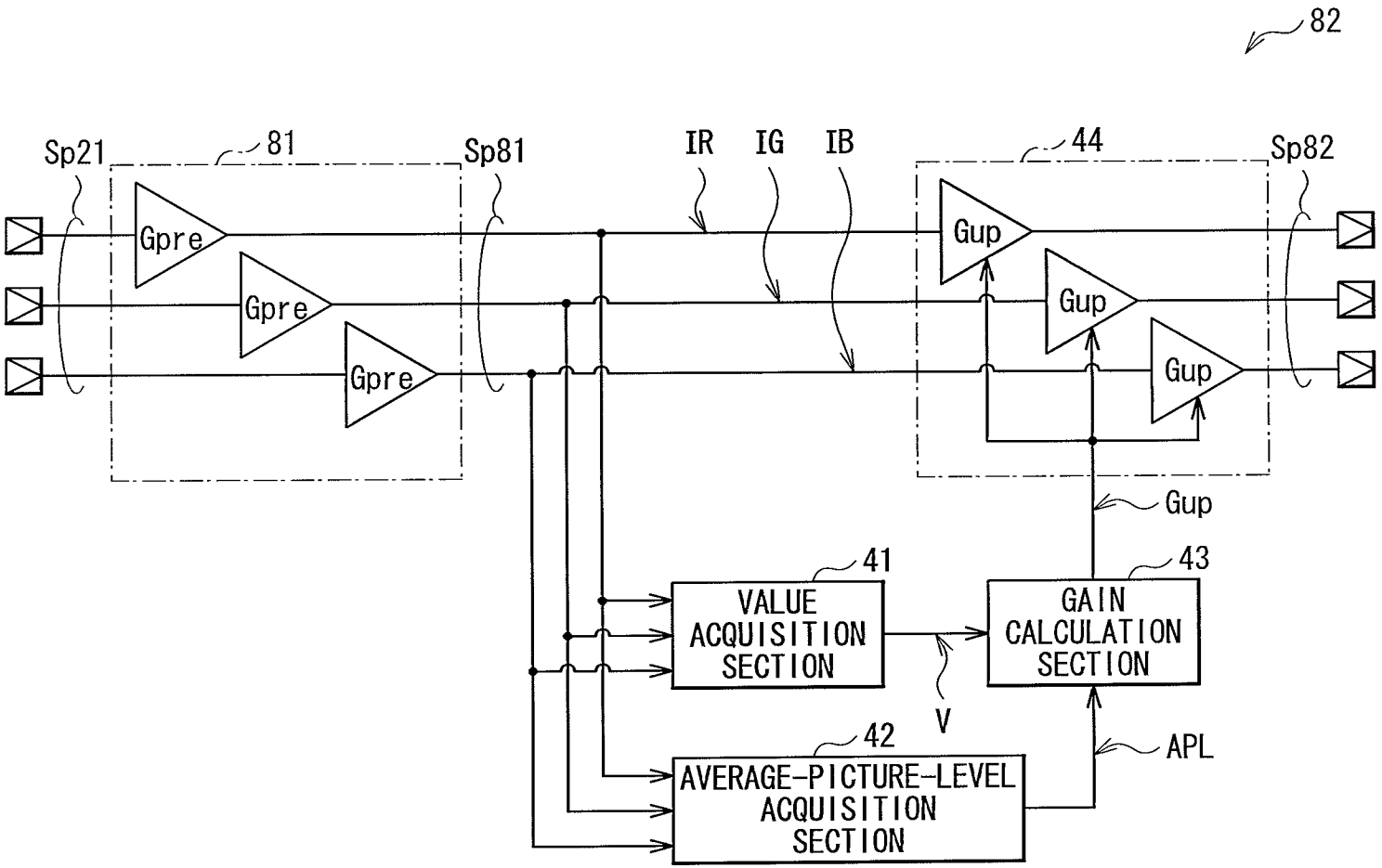
FIG. 29 is a block diagram illustrating a configuration example of a peak-luminance extension section illustrated in FIG. 27.

FIG. 29 illustrates a configuration example of the peak-luminance extension section 82. The peak-luminance extension section 82 includes a multiplication section 81. The multiplication section 81 multiplies luminance information IR, IG, and IB included in an image signal Sp21, by a common gain Gpre (e.g. 0.8) equal to or less than 1, thereby generating an image signal Sp81. A value acquisition section 41, an average-picture-level acquisition section 42, a gain calculation section 43, and a multiplication section 44 extend the peak luminances of the luminance information IR, IG, and IB included in the image signal Sp81, in a manner similar to the first embodiment.

In this way, in the display 4, after each piece of the luminance information IR, IG, and IB is reduced to be small beforehand, the peak luminance thereof is extended in a manner similar to the first embodiment. In this process, the peak luminance is allowed to be extended as much as the reduction in the luminance information IR, IG, and IB. This allows the peak luminance to be extended, while maintaining a dynamic range.

Further, in the display 4, in a manner similar to the first embodiment, the gain Gup is changed according to the area of a bright region, and thus, the extension of the peak luminance for a part where the area of a bright region is large is allowed to be suppressed, and the luminance for a part where the area of a bright region is small is allowed to be relatively increased. Therefore, image quality is allowed to be enhanced.

As described above, effects similar to those of the first embodiment are achievable by applying the technology to the EL display including the subpixels of three colors.

[Modification 4-1]

Any of the modifications 1-1 to 1-3 of the first embodiment, the second embodiment, and the modification 2-1 thereof may be applied to the display 4 according to the fourth embodiment.

5. Application Example

Next, an application example of the displays in the above-described embodiments and modifications will be described.

Figure 30:
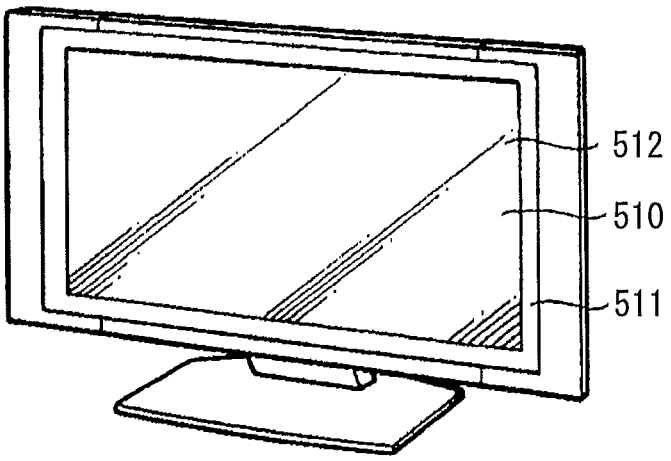
FIG. 30 is a perspective diagram illustrating an appearance configuration of a television receiver to which the display according to any of the above-mentioned embodiments is applied.

FIG. 30 illustrates an appearance of a television receiver to which the display in any of the above-described embodiments and modifications is applied. This television receiver includes, for example, an image-display screen section 510 that includes a front panel 511 and a filter glass 512. The television receiver includes the display according to any of the embodiments and modifications described above.

The display according to any of the above-described embodiments and modifications is applicable to electronic apparatuses in all fields, which display images. The electronic apparatuses include, for example, television receivers, digital cameras, laptop computers, portable terminals such as portable telephones, portable game consoles, video cameras, and the like.

The technology has been described with reference to some embodiments and modifications, as well as application examples to electronic apparatuses, but is not limited thereto and may be variously modified.

Figure 31:
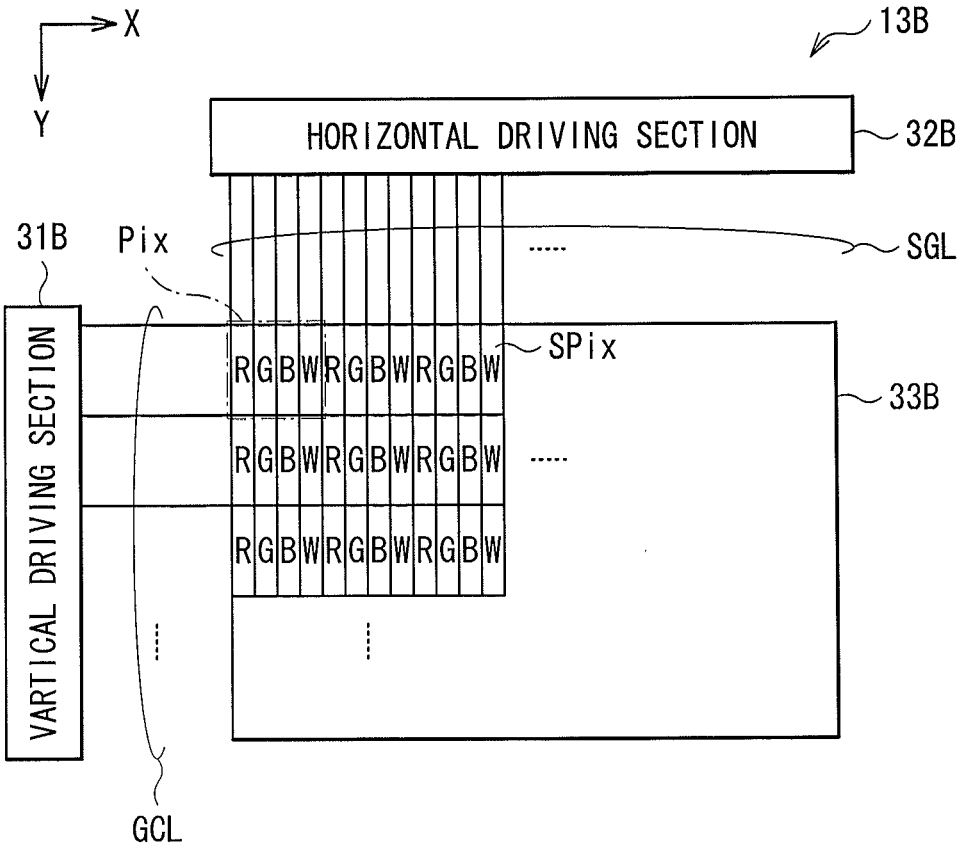
FIG. 31 is a block diagram illustrating a configuration example of an EL display section according to still another modification.

For example, in each of the above-described first to third embodiments and the like, the four subpixels SPix are arranged in two rows and two columns in the pixel array section 33 of the EL display section 13 to form the pixel Pix, but the technology is not limited thereto. Alternatively, as illustrated in FIG. 31, the pixel Pix may be configured such that four subpixels SPix each extending in a vertical direction Y are arranged side by side in a horizontal direction X. In this example, red (R), green (G), blue (B), and white (W) subpixels SPix are arranged in order from left, in the pixel Pix.

It is to be noted that the technology may be configured as follows.

(1) A display including:

a gain calculation section obtaining, according to an area of a high luminance region in a frame image, a first gain for each pixel in the region;

a determination section determining, based on first luminance information for each pixel in the high luminance region and the first gain, second luminance information for each pixel in the high luminance region; and a display section performing display based on the second luminance information.

(2) The display according to (1), wherein the first gain is increased as the area of the high luminance region is decreased.

(3) The display according to (1) or (2), wherein the gain calculation section obtains the first gain, according to an area of a high luminance region in each of divided regions into which an image region of the frame image is divided.

(4) The display according to (3), wherein the gain calculation section obtains the first gain, based on an average of pixel luminance values derived from the first luminance information in each of the divided regions.

(5) The display according to (3), wherein the gain calculation section obtains the first gain, based on a number of pixels each having a pixel luminance value equal to or larger than a predetermined threshold, the pixel luminance value being derived from the first luminance information in each of the divided regions.

(6) The display according to (4) or (5), wherein the pixel luminance value is a value of V information in an HSV color space.

(7) The display according to any one of (3) to (6), wherein the gain calculation section generates a first map based on the area of the high luminance region in each of the divided regions, generates a second map including map information for each pixel by performing scaling based on the first map, the second map having the same number of pixels as the number of pixels of the display section, and obtains the first gain based on the second map.

(8) The display according to (7), wherein, the gain calculation section includes a lookup table indicating a relationship between the first gain and the map information, and the gain calculation section obtains the first gain by using the second map and the lookup table.

(9) The display according to (7) or (8), wherein the first gain is decreased as a value of the map information is increased.

(10) The display according to any one of (7) to (9), wherein the gain calculation section smooths the first map, and generates the second map based on the smoothed first map.

(11) The display according to any one of (1) to (10), wherein the gain calculation section further obtains a second gain for each pixel based on the first luminance information, the determination section determines the second luminance information, based on the first luminance information, the first gain, and the second gain, and the second gain is increased as the pixel luminance value is increased in a range where a pixel luminance value derived from the first luminance information is equal to or above a predetermined luminance value.

(12) The display according to any one of (1) to (11), wherein the display section includes a plurality of display pixels, and each of the display pixels includes a first subpixel, a second subpixel, and a third subpixel respectively associated with wavelengths different from one another.

(13) The display according to (12), further including a compression section compressing the first luminance information to a lower luminance level, wherein the gain calculation section obtains the first gain, based on the compressed first luminance information.

(14) The display according to (12), wherein each of the display pixels further includes a fourth subpixel emitting color light different from color light of the first subpixel, the second subpixel, and the third subpixel.

(15) The display according to (14), wherein the first subpixel, the second subpixel, and the third subpixel emit the color light of red, green, and blue, respectively, and luminosity factor for the color light emitted by the fourth subpixel is substantially equal to or higher than luminosity factor for the color light of green emitted by the second subpixel.

(16) The display according to (15), wherein the fourth subpixel emits the color light of white.

(17) An image processing unit including:

a gain calculation section obtaining, according to an area of a high luminance region in a frame image, a first gain for each pixel in the region; and a determination section determining, based on first luminance information for each pixel in the high luminance region and the first gain, second luminance information for each pixel in the high luminance region.

(18) A display method including:

obtaining, according to an area of a high luminance region in a frame image, a first gain for each pixel in the region;

determining, based on first luminance information for each pixel in the high luminance region and the first gain, second luminance information for each pixel in the high luminance region; and performing display based on the second luminance information.

The disclosure contains subject matter related to that disclosed in Japanese Priority Patent Application JP 2012-140867 filed in the Japan Patent Office on Jun. 22, 2012, the entire content of which is hereby incorporated by reference.

It should be understood by those skilled in the art that various modifications, combinations, sub-combinations, and alterations may occur depending on design requirements and other factors insofar as they are within the scope of the appended claims or the equivalents thereof.

What is claimed is:

1. A display unit, comprising:

circuitry configured to:

obtain, based on an area of a first luminance region in a frame image, a first gain for each pixel in the first luminance region;

obtain a second gain, different from the first gain, for each pixel based on first luminance information for each pixel in the first luminance region;

obtain a third gain based on average picture level of the frame image;

calculate a fourth gain by a computation based on the first gain, the second gain and the third gain;

determine second luminance information for each pixel in the first luminance region based on the first luminance information and the fourth gain; and display the pixels based on the second luminance information.

2. The display unit according to claim 1, wherein the first gain is increased as the area of the first luminance region is decreased.

3. The display unit according to claim 1, wherein the circuitry is configured to obtain the first gain, based on the area of the first luminance region in each of divided regions into which an image region of the frame image is divided.

4. The display unit according to claim 3, wherein the circuitry is configured to obtain the first gain, based on an average of pixel luminance values derived from the first luminance information in each of the divided regions.

5. The display unit according to claim 4, wherein each of the pixel luminance values is a value of V information in an HSV color space.

6. The display unit according to claim 3, wherein the circuitry is configured to obtain the first gain, based on a number of pixels that each has a pixel luminance value equal to or larger than a threshold, and wherein the pixel luminance value is derived from the first luminance information in each of the divided regions.

7. The display unit according to claim 3, wherein the circuitry is configured to:

generate a first map based on the area of the first luminance region in each of the divided regions; and generate a second map that includes map information for each pixel based on the first map, wherein the second map has the same number of pixels as the number of pixels of the display unit, and obtain the first gain based on the second map.

8. The display unit according to claim 7, wherein the circuitry is configured to:

include a lookup table that indicates a relationship between the first gain and the map information; and obtain the first gain by use of the second map and the lookup table.

9. The display unit according to claim 7, wherein the first gain is decreased as a value of the map information is increased.

10. The display unit according to claim 7, wherein the circuitry is configured to:

smooth the first map, and generate the second map based on the smoothed first map.

11. The display unit according to claim 1, wherein the second gain is increased as a pixel luminance value is increased in a range where a pixel luminance value derived from the first luminance information is equal to or above a luminance value.

12. The display unit according to claim 1, wherein the display unit includes a plurality of display pixels, and each of the display pixels includes a first subpixel, a second subpixel, and a third subpixel respectively associated with wavelengths different from one another.

13. The display unit according to claim 12, wherein the circuitry is configured to:

compress the first luminance information to a lower luminance level; and obtain the first gain, based on the compressed first luminance information.

14. The display unit according to claim 12, wherein each of the display pixels further includes a fourth subpixel that emits color light different from color light of the first subpixel, the second subpixel, and the third subpixel.

15. The display unit according to claim 14, wherein the first subpixel, the second subpixel, and the third subpixel emit the color light of red, green, and blue, respectively, and luminosity factor for the color light emitted by the fourth subpixel is substantially equal to or higher than luminosity factor for the color light of green emitted by the second subpixel.

16. The display unit according to claim 15, wherein the fourth subpixel emits the color light of white.

17. The display unit according to claim 1, wherein the first luminance region is a region that has pixels that each has a pixel luminance value equal to or larger than a threshold, and wherein the frame image has a second region that has pixels that each has a pixel luminance value smaller than a threshold.

18. The display unit according to claim 1, wherein the circuitry is configured to determine the second luminance information based on multiplication of the first luminance value and the fourth gain.

19. An image processing unit, comprising:

circuitry configured to:

obtain, based on an area of a first luminance region in a frame image, a first gain for each pixel in the first luminance region;

obtain a second gain, different from the first gain, for each pixel based on first luminance information for each pixel in the first luminance region;

obtain a third gain based on average picture level of the frame image;

calculate a fourth gain by a computation based on the first gain, the second gain and the third gain; and determine second luminance information for each pixel in the first luminance region based on the first luminance information and the fourth gain.

20. A display method, comprising:

obtaining, based on an area of a first luminance region in a frame image, a first gain for each pixel in the first luminance region;

obtaining a second gain, different from the first gain, for each pixel based on first luminance information for each pixel in the first luminance region;

obtaining a third gain based on average picture level of the frame image;

calculating a fourth gain by a computation based on the first gain, the second gain and the third gain;

determining second luminance information for each pixel in the first luminance region based on the first luminance information and the fourth gain; and displaying the pixels based on the second luminance information.

* * * * *